US008906587B2

(12) United States Patent
Nakano et al.

(10) Patent No.: US 8,906,587 B2
(45) Date of Patent: Dec. 9, 2014

(54) COLORED RESIN POWDER AND TONER USING THE COLORED RESIN POWDER

(71) Applicant: Canon Kabushiki Kaisha, Tokyo (JP)

(72) Inventors: Masao Nakano, Kamakura (JP); Yutaka Tani, Yokohama (JP); Taichi Shintou, Saitama (JP); Takayuki Ujifusa, Ashigarakami-gun (JP); Satoshi Saito, Mishima (JP); Takeshi Miyazaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/658,754

(22) Filed: Oct. 23, 2012

(65) Prior Publication Data

US 2013/0108952 A1 May 2, 2013

(30) Foreign Application Priority Data

Nov. 2, 2011 (JP) ..... 2011-240744

(51) Int. Cl.
*G03G 9/09* (2006.01)

(52) U.S. Cl.
CPC ..... *G03G 9/092* (2013.01); *G03G 9/0924* (2013.01); *G03G 9/0922* (2013.01)
USPC ..... 430/108.21; 430/108.11; 430/108.2

(58) Field of Classification Search
CPC .... G03G 9/092; G03G 9/0922; G03G 9/0924
USPC ..... 430/108.21, 108.11, 108.2
See application file for complete search history.

(56) References Cited

U.S. PATENT DOCUMENTS 3,076,808 A * 2/1963 Blout et al. ..... 546/76
3,126,280 A 3/1964 Blout et al.

(Continued)

FOREIGN PATENT DOCUMENTS

JP 5-117536 A 5/1993
JP 9-255882 A 9/1997
JP 2005-320480 A 11/2005
JP 2006-243064 A 9/2006

OTHER PUBLICATIONS

Ullmann, Chem. Ber., vol. 36, 1902, pp. 2382-2384.

(Continued)

*Primary Examiner* — Peter Vajda
(74) *Attorney, Agent, or Firm* — Fitzpatrick, Cella, Harper and Scinto

(57) ABSTRACT

Provided is a colored resin powder which can reproduce even high lightness and saturation and has spectral reflectance characteristic having a wide gamut. The colored resin powder includes a water-insoluble coloring matter compound represented by the following general formula (1) and a binder resin:

General formula (1)

in which in the general formula (1), $R_1$ and $R_2$ each independently represent an alkyl group, and $R_3$ represents one of an alkyl group, an aryl group, and an alkoxy group.

4 Claims, 1 Drawing Sheet

(56) References Cited

U.S. PATENT DOCUMENTS

| | | | |
|---|---|---|---|
| 4,740,581 | A | 4/1988 | Pruett et al. |
| 5,187,282 | A | 2/1993 | Carlier et al. |
| 5,384,377 | A | 1/1995 | Weaver et al. |
| 6,813,449 | B2 | 11/2004 | Miyazaki et al. |
| 7,141,342 | B2 | 11/2006 | Toyoda et al. |
| 7,264,910 | B2 | 9/2007 | Toyoda et al. |
| 7,288,357 | B2 | 10/2007 | Toyoda et al. |
| 7,833,685 | B2 | 11/2010 | Tanaka et al. |
| 7,833,687 | B2 | 11/2010 | Kato et al. |
| 8,211,606 | B2 | 7/2012 | Murai et al. |
| 8,377,616 | B2 | 2/2013 | Tani et al. |
| 2005/0065247 | A1 | 3/2005 | Carico, Jr. et al. |
| 2012/0231388 | A1 | 9/2012 | Kawamura et al. |

OTHER PUBLICATIONS

European Search Report dated Feb. 8, 2013 in European Application No. 12189908.2.

Chinese Office Action dated Mar. 27, 2014 in Chinese Application No. 201210432372.2

* cited by examiner

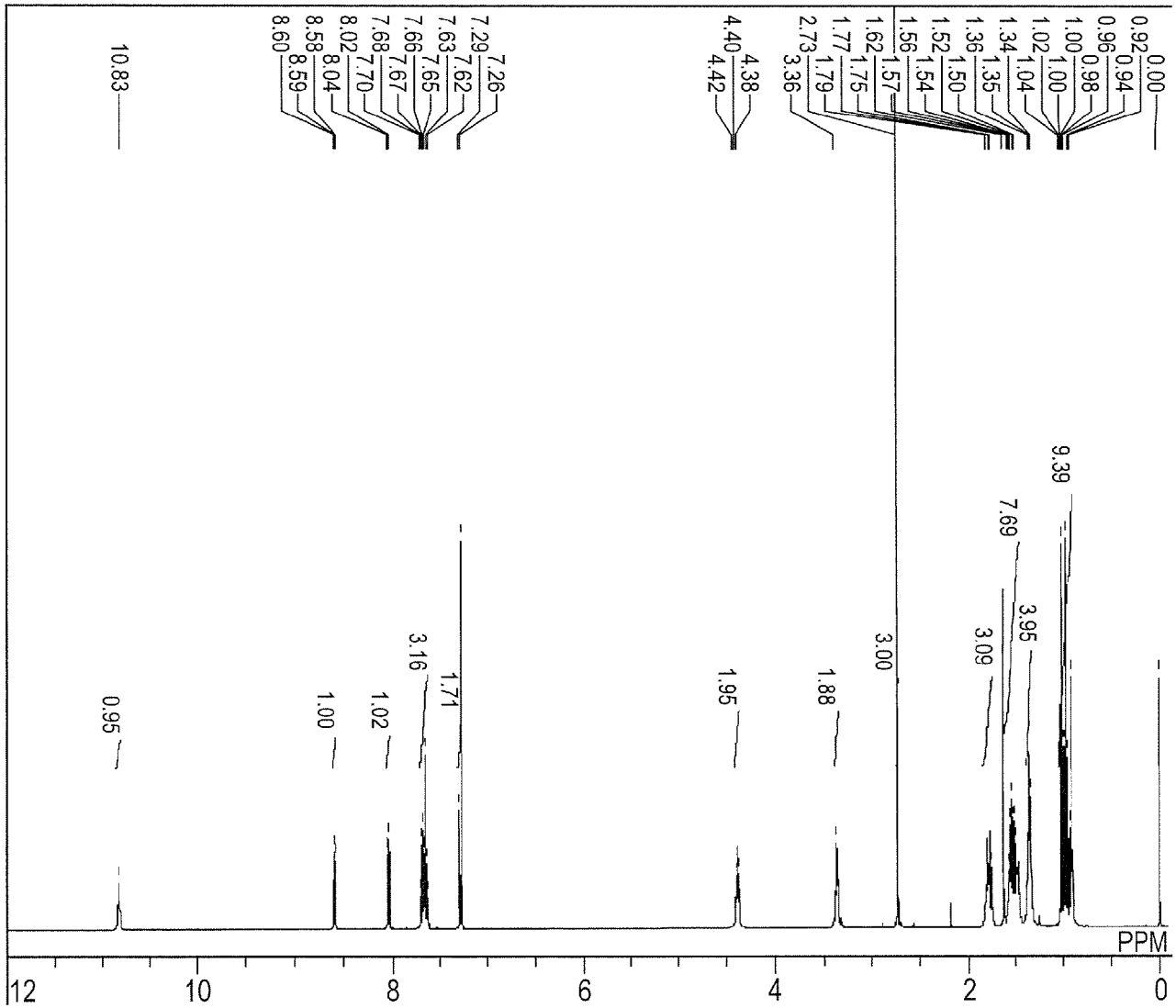
0.00
0.92
0.94
0.96
0.98
1.00
1.00
1.02
1.04
1.34
1.35
1.36
1.50
1.52
1.54
1.56
1.57
1.62
1.75
1.77
1.79
2.73
3.36
4.38
4.40
4.42
7.26
7.29
7.62
7.63
7.65
7.66
7.67
7.68
7.70
8.02
8.04
8.58
8.59
8.60
10.83
9.39
7.69
3.95
3.09
3.00
1.88
1.95
1.71
3.16
1.02
1.00
0.95
PPM
0
2
4
6
8
10
12

COLORED RESIN POWDER AND TONER USING THE COLORED RESIN POWDER

BACKGROUND OF THE INVENTION

1. Field of the Invention

The present invention relates to a colored resin powder to be used in a recording process such as an electrophotographic process, an electrostatic recording process, a magnetic recording process, a toner jet process, or a liquid development process, and to a toner using the colored resin powder.

2. Description of the Related Art

In recent years, there has been an increasing demand for an improvement in image quality along with increasing popularity of a color image. In a digital full color copying machine or printer, a color original image is subjected to color separation with filters for blue, green, and red colors, and latent images corresponding to the original image are then developed with developers for magenta, cyan, and black colors. Therefore, a coloring agent in the developer for each color has a large influence on image quality. In general, when a pigment is dispersed in various media, it is difficult to sufficiently micronize the pigment and to homogeneously disperse the pigment.

Out of color toners, a magenta toner is important for reproducing a skin color. In addition, a skin color tone in a portrait is a halftone, and hence excellent developability is also required. As a coloring agent for the magenta toner, there have been conventionally known a quinacridone-based coloring agent, a thioindigo-based coloring agent, a xanthene-based coloring agent, a monoazo-based coloring agent, a perylene-based coloring agent, and a diketopyrrolopyrrole-based coloring agent.

Further, when a dye is used as the coloring agent for the magenta toner, although a bright magenta color is exhibited at an initial stage, stability to light is low, and a variation in color tint after leaving to stand is large. Further, a clear image having high lightness is obtained in a pale color, but it is difficult to obtain a sufficient image density in a region having a deep color. Particularly in the case of mixing colors and reproducing red and blue as deep colors, a color development range is liable to become narrow. The xanthene-based coloring agent is a coloring agent satisfactory in color reproducibility and excellent in color tone. However, when the coloring agent is used in a solution state, its light fastness becomes remarkably poor, and thus various contrivances are required (see Japanese Patent Application Laid-Open No. 9-255882 and Japanese Patent Application Laid-Open No. 5-117536). Such magenta coloring agent is satisfactory in compatibility with a binder resin and light fastness and provides a magenta toner excellent in tribocharging characteristic and color tone in a fashion. However, there is a demand for a magenta toner having more additionally improved color tone, saturation, and electrophotographic characteristics in order to obtain an image which satisfies transparency and is more faithful to an original image.

SUMMARY OF THE INVENTION

The present invention has been made in order to solve the problems. That is, an object of the present invention is to provide a colored resin powder which can express even a region having high lightness and saturation and has spectral reflectance characteristic having a wide gamut. Another object of the present invention is to provide a toner containing the colored resin powder.

The objects are achieved by the present invention described below.

That is, the present invention relates to a colored resin powder, including a water-insoluble coloring matter compound represented by the following general formula (1) and a binder resin.

The present invention also relates to a toner, including at least the colored resin powder.

General formula (1)

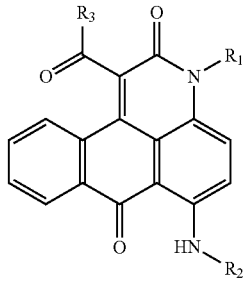

In the general formula (1), $R_1$ and $R_2$ each independently represent an alkyl group, and $R_3$ represents one of an alkyl group, an aryl group, and an alkoxy group.

According to the present invention, it is possible to provide the colored resin powder which can express even a region having high lightness and saturation and has spectral reflectance characteristic having a wide gamut, and the toner containing the colored resin powder.

Further features of the present invention will become apparent from the following description of exemplary embodiments with reference to the attached drawing.

BRIEF DESCRIPTION OF THE DRAWING

FIG. 1 shows a $^1$H NMR spectrum at 400 MHz of a compound (1) represented by the general formula (1) of the present invention in $CHCl_3$ at room temperature.

DESCRIPTION OF THE EMBODIMENTS

Hereinafter, the present invention is described in detail by way of embodiments. The inventors of the present invention have made extensive studies in order to solve the problems of the related art. As a result, the inventors have found that a colored resin powder containing a water-insoluble coloring matter compound represented by the following general formula (1) and a binder resin shows satisfactory improvements in lightness and saturation and has spectral reflectance characteristic having a wide gamut. The inventors have also found that the use of the colored resin powder provides a toner which can satisfactorily express even a region having high lightness and saturation and has spectral reflectance characteristic having a wide gamut.

General formula (1)

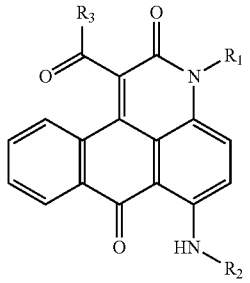

In the general formula (1), $R_1$ and $R_2$ each independently represent an alkyl group, and $R_3$ represents one of an alkyl group, an aryl group, and an alkoxy group.

<With Regard to Colored Resin Powder>

A colored resin powder of the present invention is described. The size of the colored resin powder of the present invention may be adjusted depending on applications, but one having a particle diameter of about 0.01 μm to 1,000 μm in terms of area-equivalent circle diameter is envisaged.

The colored resin powder of the present invention can express even a region having high lightness and saturation and has spectral reflectance characteristic having a wide gamut, and hence is suitable for a toner application.

The colored resin powder of the present invention contains a water-insoluble coloring matter compound represented by the general formula (1) and a binder resin.

The colored resin powder is not particularly limited as long as it is a mixture of the water-insoluble coloring matter compound represented by the general formula (1) and the binder resin. However, specific examples thereof include: one obtained by mixing the components by kneading, followed by pulverization; one obtained by melt-kneading the components, followed by dispersion in liquid with a dispersing machine; and one obtained by aggregating the water-insoluble coloring matter compound represented by the general formula (1) and the binder resin formed into fine particles in advance, followed by powderization.

When the water-insoluble coloring matter compound represented by the general formula (1) is mixed into the binder resin to form a masterbatch, even in the case of using the water-insoluble coloring matter compound represented by the general formula (1) in a large amount, dispersibility does not deteriorate. Further, when the masterbatch is used for a toner, dispersibility in toner particles is improved and color reproducibility such as color mixing property or transparency is excellent. Further, a toner having large covering power on a transfer material may be obtained. Further, through an improvement in dispersibility of a coloring agent, endurance stability of toner charging property is excellent, and an image having image quality kept at a high level can be obtained.

The use amount of the water-insoluble coloring matter compound represented by the general formula (1) is preferably 0.1 to 30 parts by mass, more preferably 0.5 to 20 parts by mass, most preferably 3 to 15 parts by mass, with respect to 100 parts by mass of the binder resin.

First, the water-insoluble coloring matter compound represented by the general formula (1) is described.

The water-insoluble coloring matter compound represented by the general formula (1) of the present invention has high compatibility with an organic solvent. It should be noted that the "water-insoluble" in the present invention refers to a water solubility of less than 1% in terms of mass percentage.

In the general formula (1), $R_1$ and $R_2$ represent an alkyl group.

The alkyl group represented by $R_1$ and $R_2$ in the general formula (1) is not particularly limited and examples thereof include linear, branched, or cyclic primary to tertiary alkyl groups having 1 to 20 atoms such as a methyl group, an ethyl group, an n-propyl group, an iso-propyl group, an n-butyl group, a sec-butyl group, a tert-butyl group, an octyl group, a dodecyl group, a nonadecyl group, a cyclobutyl group, a cyclopentyl group, a cyclohexyl group, a methylcyclohexyl group, a 2-ethylpropyl group, a 2-ethylhexyl group, and a cyclohexenylethyl group.

When $R_1$ represents a bulky secondary or tertiary alkyl group, a cyclization step hardly proceeds, resulting in a small yield in the production. Hence, a primary alkyl group such as a methyl group, a propyl group, a butyl group, an octyl group, or a 2-ethylhexyl group is preferred. Of those, a methyl group, an n-butyl group, or a 2-ethylhexyl group is particularly preferred for the production.

A case where $R_2$ represents an ethyl group, an n-butyl group, a sec-butyl group, a dodecyl group, a cyclohexyl group, a methylcyclohexyl group, a 2-ethylpropyl group, a 2-ethylhexyl group, or a cyclohexenylethyl group is preferred because even a region having high lightness and saturation of the compound can be expressed. Of those, an n-butyl group or a 2-ethylhexyl group is particularly preferred.

The alkyl group represented by $R_1$ and $R_2$ may further have a substituent. The substituent is not particularly limited as long as it does not remarkably inhibit increases in the lightness and saturation of the compound, and examples thereof include: alkoxy groups such as a methoxy group, a ethoxy group, a propoxy group, a butoxy group and a 2-ethylhexyloxy group; mono-substituted amino groups such as a methylamino group and a propylamino group; di-substituted amino groups such as a dimethylamino group, a dibutylamino group, and an N-ethyl-N-phenyl group; and a cyano group.

The alkyl group represented by $R_3$ in the general formula (1) is not particularly limited and examples thereof include linear, branched, or cyclic alkyl groups having 1 to 20 carbon atoms such as a methyl group, an ethyl group, a propyl group, a butyl group, an octyl group, a dodecyl group, a nonadecyl group, a cyclobutyl group, a cyclopentyl group, a cyclohexyl group, a methylcyclohexyl group, and an ethylhexyl group.

The aryl group represented by $R_3$ is not particularly limited and examples thereof include a phenyl group and a naphthyl group.

The alkoxy group represented by $R_3$ is not particularly limited and examples thereof include a methoxy group, an ethoxy group, a propoxy group, and a butoxy group.

$R_3$ may further have a substituent. The substituent is not particularly limited as long as it does not remarkably inhibit increases in the lightness and saturation of the compound, and examples thereof include: alkyl groups such as a methyl group, an ethyl group, a propyl group, and a butyl group; aryl groups such as a phenyl group; alkoxy groups such as a methoxy group, an ethoxy group, and a butoxy group; mono-substituted amino groups such as a methylamino group and a propylamino group; di-substituted amino groups such as a dimethylamino group, a dipropylamino group, and an N-ethyl-N-phenyl group; an amino group; and a cyano group.

A case where $R_3$ represents a methyl group, a phenyl group, a 2-methoxyphenyl group, a 4-methoxyphenyl group, or an ethoxy group is preferred. Of those, a phenyl group, a 2-methoxyphenyl group, or a 4-methoxyphenyl group is particularly preferred because of large increases in the lightness and saturation of the compound.

The compound represented by the general formula (1) according to the present invention may be synthesized, for example, with reference to a known process as described in Japanese Patent Application Laid-Open No. 2005-320480.

An aspect of a manufacturing process for the compound represented by the general formula (1) of the present invention is shown. However, the manufacturing process is not limited thereto.

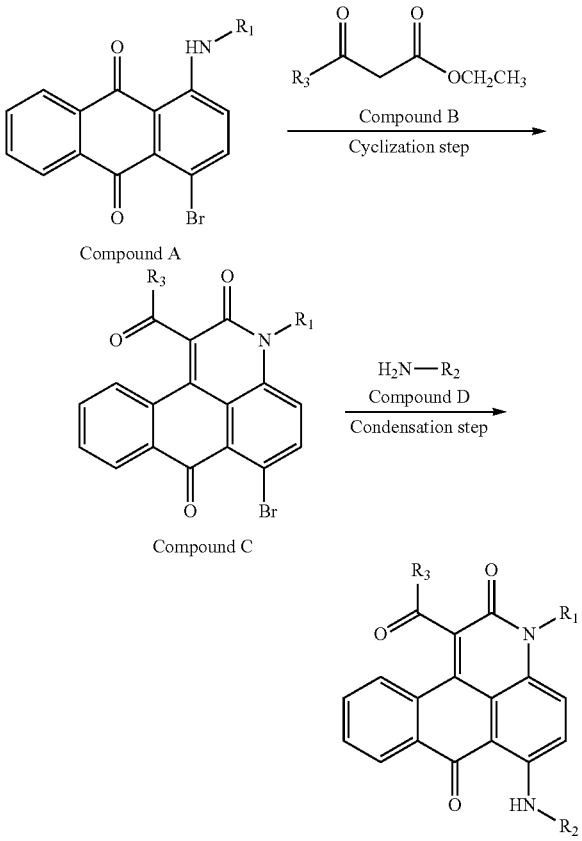

$R_1$ to $R_3$ in the compounds A to D and the general formula (1) have the same meanings as in the cases of $R_1$ to $R_3$ in the above-mentioned general formula (1).

First, a cyclization step of subjecting a compound A and a compound B to cyclization to manufacture a compound C is described.

Many kinds of commercially available products are known and easily available as the compound A to be used in the present invention.

The use amount of the compound B in this step is 0.1 to 10-fold mol, preferably 0.5 to 5-fold mol, more preferably 0.8 to 5-fold mol, with respect to the compound A.

This step is preferably performed in the presence of a solvent. The solvent is not particularly limited as long as it is not involved in the reaction, and examples thereof include: nitrile-based solvents such as acetonitrile, propionitrile, and benzonitrile; aromatic solvents such as benzene, toluene, xylene, ethylbenzene, chlorobenzene, 1,2-dichlorobenzene, and mesitylene; ether-based solvents such as diisopropyl ether, methyl tert-butyl ether, and tetrahydrofuran; and alcohol-based solvents such as butyl alcohol and diethylene glycol. Of those, aromatic solvents such as benzene, toluene, xylene, ethylbenzene, chlorobenzene, 1,2-dichlorobenzene, and mesitylene are preferred, and 1,2-dichlorobenzene, mesitylene, and the like are particularly preferred. Further, two or more kinds of solvents may be used as a mixture, and a mixing ratio upon use of the mixture may be arbitrarily determined.

The use amount of the reaction solvent falls within a range of 0.1 to 1,000-fold mass, preferably 0.5 to 500-fold mass, more preferably 1.0 to 150-fold mass, with respect to the compound A.

The reaction temperature at which this step is performed falls within a range of −80 to 300° C., preferably −20 to 250° C., more preferably 0 to 220° C. In general, the reaction is completed within 48 hours.

In this step, the reaction rapidly proceeds by the addition of an acid or a base as necessary. The acid to be used is not particularly limited as long as it is not involved in the reaction, and examples thereof include: inorganic acids such as hydrochloric acid, sulfuric acid, and phosphoric acid; organic acids such as p-toluenesulfonic acid, formic acid, acetic acid, propionic acid, and trifluoroacetic acid; strongly acidic ion-exchange resins such as Amberlite (Rohm and Haas Company) and Amberlyst (Rohm and Haas Company); and inorganic acid salts such as ammonium formate and ammonium acetate. Of those, phosphoric acid, p-toluenesulfonic acid, acetic acid, and the like are preferred.

The use amount of the acid is 0.1 to 50-fold mol, preferably 1 to 30-fold mol, more preferably 2 to 10-fold mol, with respect to the compound A.

Specific examples of the base to be used in this step include: metal alkoxides such as potassium tert-butoxide, sodium tert-butoxide, sodium methoxide, and sodium ethoxide; organic bases such as piperidine, pyridine, 2-methylpyridine, diethylamine, triethylamine, isopropylethylamine, potassium acetate, and 1,8-diazabicyclo[5.4.0]undeca-7-ene (DBU); n-butyl lithium; and inorganic bases such as magnesium chloride, sodium borohydride, metallic sodium, sodium hydride, sodium carbonate, and sodium hydrogen carbonate. Of those, sodium methoxide, sodium ethoxide, potassium acetate, sodium carbonate, sodium hydrogen carbonate, and the like are preferred.

The use amount of the base is 0.1 to 15-fold mol, preferably 1 to 8-fold mol, more preferably 1.4 to 5-fold mol, with respect the compound A.

After the completion of the reaction, the resultant is diluted with 2-propyl alcohol and hexane, and a precipitated solid can be filtered to yield a compound C.

Next, a condensation step is described. The condensation step falls within the category of a known reaction to be classified as an Ullmann condensation reaction (Chem. Ber., 36, 2382 (1902)). That is, the compound C and a compound D (amine compound) are subjected to condensation to yield the general formula (1) of the present invention. As a specific amination reaction, for example, a process shown below is given.

The use amount of the compound D in this step is 0.1 to 10-fold mol, preferably 0.5 to 5-fold mol, more preferably 0.8 to 5-fold mol, with respect to the compound C.

A condensation agent to be used in this step is not particularly limited and a condensation agent to be generally used in the Ullmann condensation reaction may be used. Examples thereof include copper powder and copper compounds such as cuprous chloride, cupric chloride, cuprous bromide, cupric bromide, copper iodide, copper acetate, and copper sulfate. Preferred examples thereof include copper iodide.

The use amount of the condensation agent is preferably 0.0005 to 0.1 mol, more preferably 0.001 to 0.05 mol, with respect to 1 mol of the compound C.

In order to promote the reaction, a promoter for the condensation agent may be used in this step.

The promoter for the condensation agent is not particularly limited as long as it is used in the known reaction to be classified as the Ullmann condensation reaction. For example, 2,2'-bipyridyl and 1,10-phenanthroline are preferred because they are inexpensive and are easily utilized.

An organic solvent to be used in the condensation step is described.

The organic solvent which may be used in this step is not particularly limited as long as the organic solvent is not involved in the reaction, and there may be used, for example, methanol, ethanol, n-propanol, isopropanol, n-butanol, toluene, xylene, ethylene glycol, N-methylpyrrolidone, N,N-dimethylacetamide, N,N-dimethylformamide, dimethyl sulfoxide, sulfolane, chlorobenzene, dichlorobenzene, trichlorobenzene, and nitrobenzene alone or in combination of two or more kinds thereof depending on the solubility of the substrate.

This step is generally performed within a temperature range of 0 to 220° C. and is generally completed within 24 hours.

A reaction temperature in the condensation step preferably falls within a range of 5 to 180° C., and is more preferably 10 to 120° C. A temperature of less than 0° C. is not preferred because the progress of the reaction becomes remarkably slow. Further, a temperature of more than 220° C. is not preferred because the decomposition of the compound may occur.

The resultant compound represented by the general formula (1) may be treated according to a general post-treating process for an organic synthesis reaction and then subjected to purification such as recrystallization, reprecipitation, or column chromatography to yield a high-purity water-insoluble coloring matter compound. The water-insoluble coloring matter compound represented by the general formula (1) may be identified through the use of, for example, $^1$H nuclear magnetic resonance spectral analysis, LC/TOF MS, or a UV/Vis spectrophotometer.

It may be appropriately selected by a person skilled in the art to add known protection and deprotection reactions, hydrolysis, and other reactions in a functional group of each compound, as necessary.

Further, when the substituents $R_1$ and $R_2$ are the same, the compound represented by the general formula (1) of the present invention may be obtained by subjecting a compound E and the compound B to cyclization as shown below. This cyclization step may be performed in the same manner as in the cyclization step of subjecting the compound A and the compound B to cyclization to manufacture the compound C.

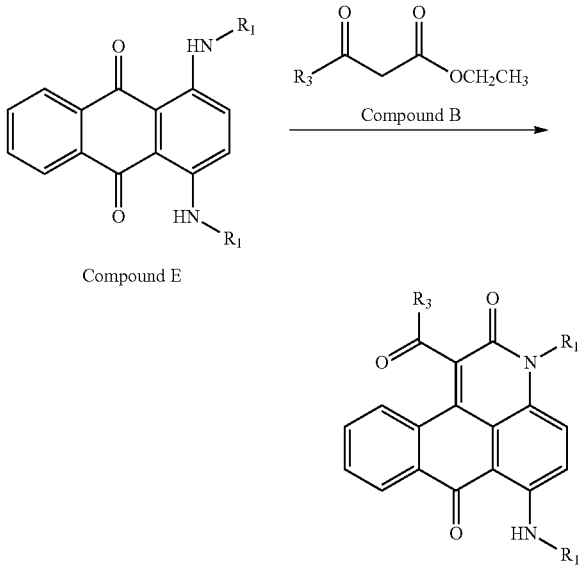

The compound represented by the general formula (1) of the present invention may be used alone or may be used in combination of two or more kinds thereof in order to adjust a color tone and the like depending on purposes of use applications. In addition, two or more kinds of known pigments and dyes may be used in combination.

Water-insoluble coloring matter compounds (1) to (21) are shown below as preferred specific examples of the water-insoluble coloring matter compound of the present invention. However, the water-insoluble coloring matter compound is not limited to the following examples. It should be noted that the water-insoluble coloring matter compounds (1) to (21) are obtained by adopting substituents in Table 1 as $R_1$, $R_2$, and $R_3$ in the following general formula. "*" represents a bonding site of a substituent.

General formula (1)

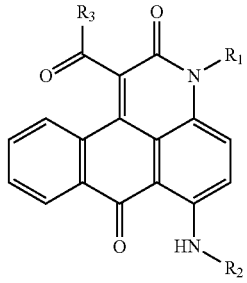

TABLE 1

| Water-insoluble compound | $R_1$ | $R_2$ | $R_3$ |
|---|---|---|---|
| 1 | $CH_3CH_2CH_2CH_2$—* | 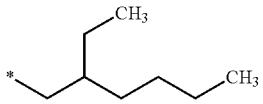 | CH3 |

TABLE 1-continued
| Water-insoluble compound | $R_1$ | $R_2$ | $R_3$ |
|---|---|---|---|
| 2 | 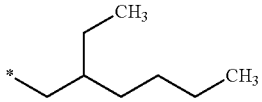 | $CH_3CH_2CH_2CH_2$—* | $CH_3$ |
| 3 | $CH_3$ | 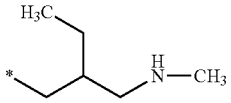 | $CH_3$ |
| 4 | $CH_3CH_2CH_2CH_2$—* | 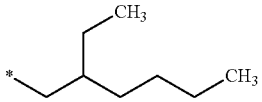 | $C_6H_5$ |
| 5 | $CH_3CH_2CH_2CH_2$—* | 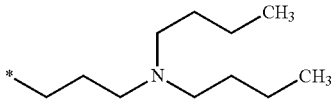 | $C_6H_5$ |
| 6 | $CH_3CH_2CH_2CH_2$—* | 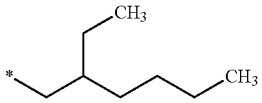 | 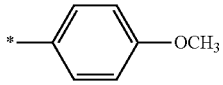 |
| 7 | n-$C_8H_{17}$—* | $CH_3CH_2CH_2CH_2$—* | 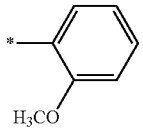 |
| 8 | 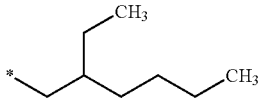 | 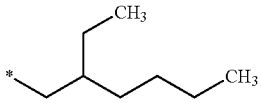 | $C_6H_5$ |
| 9 | 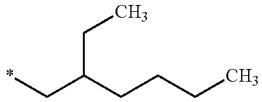 | 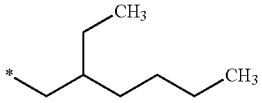 | *—$OCH_2CH_3$ |
| 10 | 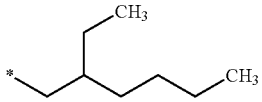 | 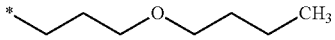 | $C_6H_5$ |
| 11 | 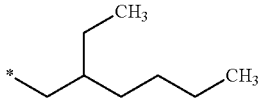 | 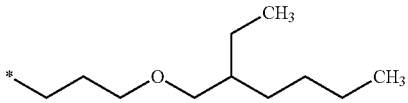 | $C_6H_5$ |
| 12 | 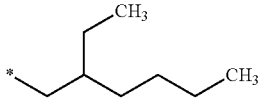 | 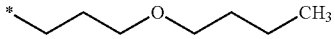 | *—$OCH_2CH_3$ |
| 13 | $CH_3$ | 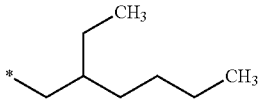 | 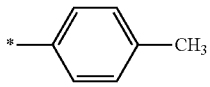 |
| 14 | $CH_3$ | 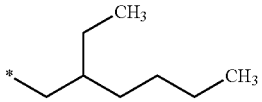 | $C_6H_5$ |

TABLE 1-continued

| Water-insoluble compound | $R_1$ | $R_2$ | $R_3$ |
|---|---|---|---|
| 15 | 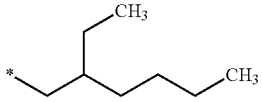 | 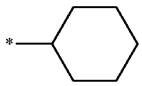 | $C_6H_5$ |
| 16 | 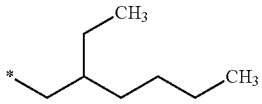 | 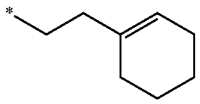 | $C_6H_5$ |
| 17 | $CH_3$ | n-$C_{12}H_{25}$—* | $C_6H_5$ |
| 18 | 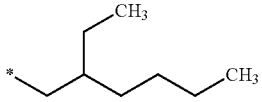 | 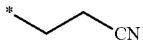 | $C_6H_5$ |
| 19 | 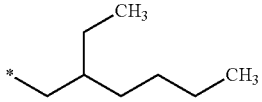 | 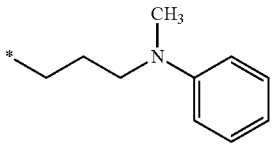 | $C_6H_5$ |
| 20 | $CH_3CH_2CH_2CH_2$—* | $CH_3CH_2CH_2CH_2$—* | 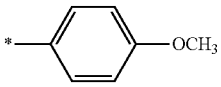 |
| 21 | $CH_3CH_2CH_2CH_2$—* | $CH_3CH_2CH_2CH_2$—* | $C_6H_5$ |

<Binder Resin>

A binder resin to be used in the present invention is not particularly limited and examples thereof may include a thermoplastic resin.

Specific examples thereof include: homopolymers or copolymers of styrenes such as styrene, p-chlorostyrene, and α-methylstyrene (styrene-based resins); homopolymers or copolymers of esters having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate (vinyl-based resins); homopolymers or copolymers of vinylnitriles such as acrylonitrile and methacrylonitrile (vinyl-based resins); homopolymers or copolymers of vinyl ethers such as vinyl ethyl ether and vinyl isobutyl ether (vinyl-based resins); homopolymers or copolymers of ketones such as vinyl methyl ketone, vinyl ethyl ketone, and vinyl isopropenyl ketone (vinyl-based resins); homopolymers or copolymers of olefins such as ethylene, propylene, butadiene, and isoprene (olefin-based resins); and non-vinyl condensation resins such as an epoxy resin, a polyester resin, a polyurethane resin, a polyamide resin, a cellulose resin, and a polyether resin, and graft polymers of these non-vinyl condensation resins and vinyl-based monomers. One kind of those resins may be used alone, or two or more kinds thereof may be used in combination.

Further, the polyester resin is synthesized from an acid-derived constituent component (dicarboxylic acid) and an alcohol-derived constituent component (diol). In the present invention, the "acid-derived constituent component" refers to a constituent part which has been an acid component before the synthesis of the polyester resin, and the "alcohol-derived constituent component" refers to a constituent part which has been an alcohol component before the synthesis of the polyester resin.

The acid-derived constituent component of the present invention is not particularly limited and examples thereof include a constituent component derived from an aliphatic dicarboxylic acid, a constituent component derived from a dicarboxylic acid having a double bond, and a constituent component derived from a dicarboxylic acid having a sulfonic acid group. Specific examples thereof include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, and lower alkyl esters and acid anhydrides thereof. In particular, a constituent component derived from an aliphatic dicarboxylic acid is desirable, and further, an aliphatic moiety in the aliphatic dicarboxylic acid is preferably a saturated carboxylic acid.

The alcohol-derived constituent component is not particularly limited but is desirably an aliphatic diol. Examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, and 1,20-eicosanediol.

In the present invention, a crosslinking agent may be used at the time of the synthesis of the binding resin for improving the mechanical strength of the colored resin powder, and at the same time, for controlling its molecular weight.

The crosslinking agent to be used in a toner is not particularly limited and examples thereof include bifunctonal crosslinking agents such as divinylbenzene, bis(4-acryloxy-polyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycols #200, #400, and #600, dipropylene glycol diacrylate, polypropylene glycol diacrylate, polyester-type diacrylates, and ones obtained by changing the diacrylates to dimethacrylates.

A polyfunctional crosslinking agent is not particularly limited and examples thereof include pentaerythritol triacrylate, trimethylolethane triacrylate, trimethylolpropane triacrylate, tetramethylolmethane tetraacrylate, oligoester acrylate and methacrylate thereof, 2,2-bis(4-mathacryloxyphenyl)propane, diallyl phthalate, triallyl cyanurate, triallyl isocyanurate, and triallyl trimellitate.

Any such crosslinking agent is used in an amount of preferably 0.05 to 10 parts by mass, more preferably 0.1 to 5 parts by mass, with respect to 100 parts by mass of the monomer.

<Preparation Process for Colored Resin Powder>

The colored resin powder of the present invention may be manufactured with a known manufacturing apparatus such as a mixing machine or a heat kneading machine.

First, a binder resin and the water-insoluble coloring matter compound of the present invention are mixed well with a mixing machine such as a Henschel mixer or a ball mill. Next, the mixture is melted with a heat kneading machine such as a roll, a kneader, or an extruder. The melt is milled and kneaded to dissolve the resins with each other. After solidification by cooling, the resultant can be pulverized to yield a colored resin powder.

Further, by virtue of mixing the water-insoluble coloring matter compound represented by the general formula (1) with the binder resin, the colored resin powder according to the present invention does not cause any deterioration in colorant performance of the water-insoluble coloring matter compound and can provide stable color development in a sustained manner over a long period of time as compared to the case of using the water-insoluble coloring matter compound alone.

The colored resin powder of the present invention may be used in combination with a pigment or a dye as a coloring agent as long as the dispersibility of constituent components and a hue of interest are not inhibited.

Next, a toner of the present invention is described.

The toner of the present invention is a toner containing the colored resin powder.

A manufacturing process for toner particles constituting the toner of the present invention is, for example, a pulverization process, an emulsion polymerization process, or an emulsion aggregation process. From the viewpoints of an environmental load at the time of the manufacture and the controllability of a particle diameter, the toner particles are preferably manufactured by an emulsion aggregation process among those manufacturing processes, which involves granulation mainly in an aqueous medium. Further, the colored resin powder of the present invention may be used for a developer to be used in a liquid development process (hereinafter, referred to as liquid developer).

The toner particles contain, in addition to the binder resin, a coloring agent, a wax, a charge controlling agent, and the like, as necessary. Further, an external additive is preferably added to the toner particles.

The wax means a material to be used for the purpose of preventing offset in the fixation of the toner. Specifically, for example, the following waxes are used in many cases: hydrocarbon-based waxes such as a low-molecular weight polyethylene, a low-molecular weight polypropylene, a microcrystalline wax, and a paraffin wax; oxides of hydrocarbon-based waxes such as a polyethylene oxide wax or block copolymers thereof; fatty acid ester-based waxes such as a carnauba wax, a sasol wax, and a montanic acid ester wax; partially or wholly deacidified fatty acid esters such as a deacidified carnauba wax; saturated linear fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; polyhydric alcohols such as sorbitol; fatty acid amides such as linoleic acid amide, oleic acid amide, and lauric acid amide; saturated fatty acid bisamides such as methylenebisstearic acid amide, ethylenebiscapric acid amide, ethylenebislauric acid amide, and hexamethylenebisstearic acid amide; unsaturated fatty acid amides such as ethylenebisoleic acid amide, hexamethylenebisoleic acid amide, N,N'-dioleyladipic acid amide, and N,N'-dioleylsebacic acid amide; aromatic bisamides such as m-xylenebisstearic acid amide and N,N'-distearylisophthalic acid amide; fatty acid metal salts (generally referred to as metal soaps) such as calcium stearate, calcium laurate, zinc stearate, and magnesium stearate; waxes obtained by grafting aliphatic hydrocarbon-based waxes with vinyl-based monomers such as styrene and acrylic acid; partially esterified products of fatty acids and polyhydric alcohols, such as behenic monoglyceride; methyl ester compounds having a hydroxyl group obtained by the hydrogenation of vegetable fats and oils; and long-chain alkyl alcohols or long-chain alkylcarboxylic acids having 12 or more carbon atoms. Of those, hydrocarbon-based waxes, fatty acid ester-based waxes, and saturated alcohols are mentioned as preferred examples from the viewpoint of a balance between mold releasability and dispersibility in a resin. Further, one kind of those waxes may be used alone, or two or more kinds thereof may be used in combination as necessary.

The content of the wax of the present invention in the toner is preferably 1 to 25 parts by mass, more preferably 3 to 20 parts by mass, with respect to 100 parts by mass of the toner particles. When the wax component is less than 1 part by mass, a releasing effect as the wax lowers. On the other hand, when the wax component is more than 25 parts by mass, although releasing property is satisfied, developability lowers, and a negative effect such as fusion of the toner on a surface of a developing sleeve or an electrostatic latent image bearing member is liable to occur.

The wax of the present invention is preferably one having a melting point of 50° C. or more and 200° C. or less, more preferably one having a melting point of 55° C. or more and 150° C. or less. It should be noted that, when the melting point of the wax is less than 50° C., the blocking resistance property of the toner may lower, and when the melting point is more than 200° C., the exudation property of the wax upon fixation lowers, and releasability in oilless fixation may lower.

It should be noted that the melting point in the present invention refers to a main endothermic peak temperature in a differential scanning calorimetry (DSC) curve measured in conformity with ASTM D3418-82. Specifically, a DSC curve within a temperature range of 30 to 200° C. is obtained by the second temperature increasing process under a normal-temperature and normal-humidity environment through the use of a differential scanning calorimeter (manufactured by Mettler Toledo International Inc.: DSC822) within a measurement temperature range of 30 to 200° C. at a rate of temperature increase of 5° C./min, and the melting point of the wax is a main endothermic peak temperature in the resultant DSC curve.

The addition amount of the wax of the present invention falls within preferably a range of 2.5 to 15.0 parts by mass, more preferably a range of 3.0 to 10.0 parts by mass, with respect to 100 parts by mass of the binder resin. When the addition amount of the wax is less than 2.5 parts by mass, oilless fixation becomes difficult. When the addition amount is more than 15.0 parts by mass, the amount of the wax in the toner particles is too large, and an excessive wax is present in a large amount on a toner particle surface, which may inhibit desired charging property. Thus, both the cases are not preferred.

Coloring agents to be used may be used in combination as long as the hue of the water-insoluble coloring matter compound contained in the colored resin powder of the present invention is not inhibited. The coloring agents may be exemplified by a condensed azo compound, an azo metal complex, a diketopyrrolopyrrole compound, an anthraquinone compound, a quinacridone compound, a basic dye lake compound, a naphthol compound, a benzimidazolone compound, a thioindigo compound, a perylene compound, a methine compound, and an allylamide compound, but need to be carefully selected.

The content of the coloring agent is preferably 1 to 20 parts by mass with respect to 100 parts by mass of the resin. When the content is less than 1 part by mass, it may be difficult to ensure a sufficient toner density. When the content is more than 20 parts by mass, the coloring agent to be excluded from the toner particles tends to increase.

As the charge controlling agent, a known one may be utilized, and a charge controlling agent which has a high charging speed and can stably maintain a certain charging amount is particularly preferred. In addition, when the toner is manufactured by a direct polymerization process, a charge controlling agent which has low polymerization inhibition property and is substantially free of any substance soluble in an aqueous dispersion medium is particularly preferred.

The charge controlling agent is exemplified by charge controlling agents for controlling the toner so as to have a negative charge, such as a polymer or copolymer having a sulfonic acid group, a sulfonic acid salt group, or a sulfonic acid ester group, a salicylic acid derivative and a metal complex thereof, a monoazo metal compound, an acetylacetone metal compound, an aromatic oxycarboxylic acid, aromatic mono- and polycarboxylic acids and metal salts, anhydrides, and esters thereof, phenol derivatives such as bisphenol, a urea derivative, a metal-containing naphthoic acid-based compound, a boron compound, a quaternary ammonium salt, a calixarene, and a resin-based charge controlling agent.

The charge controlling agent is also exemplified by charge controlling agents for controlling the toner so as to have a positive charge, such as: nigrosine-modified products with nigrosine, fatty acid metal salts, and the like; guanidine compounds; imidazole compounds; quaternary ammonium salts such as tributylbenzylammonium 1-hydroxy-4-naphthosulfonate and tetrabutylammonium tetrafluoroborate, and analogues thereof including onium salts such as phosphonium salts and lake pigments thereof; triphenylmethane dyes and lake pigments thereof (laking agents include phosphotungstic acid, phosphomolybdic acid, phosphotungstic molybdic acid, tannic acid, lauric acid, gallic acid, ferricyanides, and ferrocyanides); metal salts of higher fatty acids; diorganotin oxides such as dibutyl tin oxide, dioctyl tin oxide, and dicyclohexyl tin oxide; diorganotin borates such as dibutyl tin borate, dioctyl tin borate, and dicyclohexyl tin borate; and a resin-based charge controlling agent. One kind of those charge controlling agents may be used alone, or two or more kinds thereof may be used in combination.

Inorganic fine powder may be added as an external additive to the toner of the present invention. Fine powder of, for example, silica, titanium oxide, alumina, or a complex oxide thereof, or a product obtained by treating the surface of any such oxide may be used as the inorganic fine powder. Further, resin particles of a vinyl-based resin, a polyester resin, a silicone resin, or the like may be added. Those inorganic fine powders and resin particles function as a fluidity aid, a cleaning aid, and the like.

The toner of the present invention has preferably a weight-average particle diameter D4 of 4.0 to 9.0 μm and a ratio of the weight-average particle diameter D4 to a number-average particle diameter D1 (hereinafter, also referred to as weight-average particle diameter D4/number-average particle diameter D1 or D4/D1) of 1.35 or less, more preferably a weight-average particle diameter D4 of 4.9 to 7.5 μm and a ratio of weight-average particle diameter D4/number-average particle diameter D1 of 1.30 or less. When the ratio of less than 4.0 μm increases in a value for the weight-average particle diameter D4, in the case of applying the toner to an electrophotographic development system, it becomes difficult to achieve charging stabilization, and image deterioration such as image fogging or a development stripe is liable to occur in the continuous development operation (endurance operation) of a large number of images. In particular, when fine powder having a diameter of 2.5 μm or less increases, such tendency becomes remarkable. Further, when the ratio of a weight-average particle diameter D4 of more than 8.0 μm increases, the reproducibility of a halftone portion drastically lowers, and the resultant image is a rough image, which is not preferred. In particular, when coarse powder having a diameter of 10.0 μm or more increases, such tendency appears remarkably. When the ratio of weight-average particle diameter D4/number-average particle diameter D1 is more than 1.35, fogging or a reduction in transferability occurs, and a variation in width of a line such as a thin line becomes large (hereinafter, referred to as reduction in sharpness).

The toner of the present invention has an average circularity of the toner of preferably 0.930 to 0.995, more preferably 0.960 to 0.990, which is measured with a flow-type particle image analyzer, because the transferability of the toner is improved to a great extent.

The toner of the present invention may be any of a magnetic toner and a non-magnetic toner. When the toner is used as the magnetic toner, toner particles constituting the toner of the present invention may be mixed with a magnetic material before use. Examples of the magnetic material include iron oxides such as magnetite, maghemite, and ferrite or iron oxides containing other metal oxides, metals such as Fe, Co, and Ni or alloys of these metals and metals such as Al, Co, Cu, Pb, Mg, Ni, Sn, Zn, Sb, Be, Bi, Cd, Ca, Mn, Se, Ti, W, and V, and mixtures thereof.

<Manufacturing Process for Pulverization Process Toner>

In a pulverization process toner, in addition to the colored resin powder, a magnetic substance, a wax, a charge controlling agent, other additives, and the like are used, as necessary.

The pulverization process toner may be manufactured with a manufacturing apparatus known to a person skilled in the art, such as a mixing machine, a heat kneading machine, or a classification machine.

First, those materials are mixed well with a mixing machine such as a Henschel mixer or a ball mill. Next, the mixture is melted with a heat kneading machine such as a roll, a kneader, or an extruder. The melt is milled and kneaded to dissolve the resins with each other, and a wax and a magnetic substance are dispersed therein. After solidification by cooling, the resultant can be pulverized and classified to yield a toner.

Examples of the binder resin to be used in the pulverization process toner include a vinyl-based resin, a polyester-based resin, an epoxy-based resin, a polyurethane-based resin, a polyvinyl butyral-based resin, a terpene-based resin, a phenol-based resin, an aliphatic or alicyclic hydrocarbon-based resin, an aromatic petroleum-based resin, rosin, and modified rosin. Of those, a vinyl-based resin and a polyester-based resin are more preferred from the viewpoints of charging property and fixability. A polyester-based resin is particularly preferably used because the effects of charging property and fixability become large.

One kind of those resins may be used alone or two or more kinds thereof may be used in combination.

In the case where two or more kinds of resins are mixed to be used, it is preferred that resins having different molecular weights be mixed in order to control the viscoelastic property of the toner.

The glass transition temperature of the binder resin to be used for the pulverization process toner is preferably 45 to 80° C., more preferably 55 to 70° C., the number-average molecular weight (Mn) thereof is preferably 2,500 to 50,000, and the weight-average molecular weight (Mw) thereof is preferably 10,000 to 1,000,000.

The polyester-based resin is not particularly limited but is particularly preferably one having a molar ratio of an alcohol component to an acid component of 45/55 to 55/45 among all the components.

In the polyester-based resin, the environmental dependency of the charging property of the toner becomes larger as the number of terminal groups in a molecular chain becomes larger. Therefore, the acid value is preferably 90 mg KOH/g or less, more preferably 50 mg KOH/g or less. Further, the hydroxyl value is preferably 50 mg KOH/g or less, more preferably 30 mg KOH/g or less.

The glass transition temperature of the polyester resin is preferably 50 to 75° C., more preferably 55 to 65° C.

In addition, the number-average molecular weight (Mn) thereof is preferably 1,500 to 50,000, more preferably 2,000 to 20,000.

Further, the weight average molecular weight (Mw) thereof is preferably 6,000 to 100,000, more preferably 10,000 to 90,000.

<Manufacturing Process for Suspension Polymerization Process Toner>

Toner particles to be manufactured by a suspension polymerization process of the present invention are manufactured as described below, for example. First, a water-insoluble coloring matter compound, a polymerizable monomer, a wax component, a polymerization initiator, and the like are mixed to prepare a polymerizable monomer composition. Next, the polymerizable monomer composition is dispersed in an aqueous medium to form particles of the polymerizable monomer composition. Then, the polymerizable monomer in the particles of the polymerizable monomer composition is polymerized in an aqueous medium to yield toner particles.

The polymerizable monomer composition in the above-mentioned step is preferably prepared by mixing a dispersion, which is obtained by dispersing the above-mentioned water-insoluble coloring matter compound in a first polymerizable monomer, with a second polymerizable monomer. That is, the water-insoluble coloring matter compound is sufficiently dispersed by the first polymerizable monomer and then mixed with the second polymerizable monomer together with other toner materials. Thus, the water-insoluble coloring matter compound can be present in the toner particles in a more satisfactory dispersion state.

Examples of the polymerizable monomer may include: styrenes such as styrene, p-chlorostyrene, and α-methylstyrene; acrylic acid ester monomers or methacrylic acid ester monomers such as methyl acrylate, ethyl acrylate, n-propyl acrylate, lauryl acrylate, 2-ethylhexyl acrylate, methyl methacrylate, ethyl methacrylate, n-propyl methacrylate, lauryl methacrylate, 2-ethylhexyl methacrylate, acrylonitrile, and methacrylonitrile; vinyl ether-based monomers such as vinyl methyl ether and vinyl isobutyl ether; and vinyl ketone-based monomers such as vinyl methyl ketone, vinyl ethyl ketone, and vinyl isopropenyl ketone.

A known polymerization initiator may be given as the polymerization initiator to be used in the suspension polymerization process, and examples thereof include an azo compound, an organic peroxide, an inorganic peroxide, an organometallic compound, and a photopolymerization initiator. More specific examples thereof include: azo-based polymerization initiators such as 2,2'-azobis(isobutyronitrile), 2,2'-azobis(2-methylbutyronitrile), 2,2'-azobis(4-methoxy-2,4-dimethylvaleronitrile), 2,2'-azobis(2,4-dimethylvaleronitrile), and dimethyl 2,2'-azobis(isobutyrate); organic peroxide-based polymerization initiators such as benzoyl peroxide, di-tert-butyl peroxide, tert-butylperoxyisopropyl monocarbonate, tert-hexylperoxy benzoate, and tert-butylperoxy benzoate; inorganic peroxide-based polymerization initiators such as potassium persulfate and ammonium persulfate; and redox initiators such as hydrogen peroxide-ferrous, BPO-dimethylaniline-based, and cerium(IV) salt-alcohol-based redox initiators. Examples of the photopolymerization initiator include acetophenone-based, benzoin ether-based, and ketal-based photopolymerization initiators. Those polymerization initiators may be used alone, or in combination of two or more thereof.

The case where the concentration of the polymerization initiator falls within a range of 0.1 to 20 parts by mass with respect to 100 parts by mass of the polymerizable monomer is preferred. The case where the concentration falls within a range of 0.1 to 10 parts by mass is more preferred. The polymerizable initiator, the kind of which slightly varies depending on a polymerization process, is used alone or as a mixture with reference to its 10-hour half-life temperature.

A dispersion stabilizer is preferably incorporated into the aqueous medium to be used in the suspension polymerization process. As the dispersion stabilizer, known inorganic and organic dispersion stabilizers may be used. Examples of the inorganic dispersion stabilizer include calcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina. Examples of the organic dispersion stabilizer include polyvinyl alcohol, gelatin, methylcellulose, methylhydroxypropylcellulose, ethylcellulose, a sodium salt of carboxymethylcellulose, and starch. In addition, nonionic, anionic, and cationic surfactants may also be utilized, and examples thereof include sodium dodecyl sulfate, sodium tetradecyl sulfate, sodium pentadecyl sulfate, sodium octyl sulfate, sodium oleate, sodium laurate, potassium stearate, and calcium oleate.

Of the dispersion stabilizers, a hardly water-soluble, inorganic dispersion stabilizer that is soluble in an acid is preferably used in the present invention. In addition, in the present invention, when an aqueous dispersion medium is prepared with the hardly water-soluble, inorganic dispersion stabilizer, such dispersion stabilizer is preferably used at a ratio in a range of 0.2 to 2.0 parts by mass with respect to 100 parts by mass of the polymerizable monomer in terms of the droplet stability of the polymerizable monomer composition in the aqueous medium. In addition, in the present invention, the aqueous medium is preferably prepared with water whose amount ranges from 300 to 3,000 parts by mass with respect to 100 parts by mass of the polymerizable monomer composition.

<Manufacturing Process for Emulsion Aggregation Process Toner>

Next, a manufacturing process for toner particles by an emulsion aggregation process is described.

First, a mixed liquid containing the colored resin powder of the present invention and a wax dispersion is prepared. At this time, a resin particle dispersion, a coloring agent particle dispersion, and other toner components may be further mixed, as necessary.

A step of aggregating a mixed liquid thereof to form aggregate particles (aggregation step), a step of fusing the aggregate particles by heating (fusion step), a washing step, and a drying step are performed to yield toner particles.

In each of the particle dispersions, a dispersant such as a surfactant may be used. Specifically, the coloring agent particle dispersion is obtained by dispersing a coloring agent in an aqueous medium together with a surfactant. Coloring agent particles are dispersed by a known process, and for example, a medium type dispersing machine such as a rotation shearing type homogenizer, a ball mill, a sand mill, or an attritor, or a high-pressure counter collision type dispersing machine is preferably used.

Examples of the surfactant include a water-soluble polymer, an inorganic compound, and an ionic or non-ionic surfactant. In particular, an ionic surfactant having high dispersibility is preferably used from the viewpoint of dispersibility, and an anionic surfactant is particularly preferably used.

Further, the molecular weight of the surfactant is preferably 100 to 10,000, more preferably 200 to 5,000, from the viewpoints of washing property and surface active performance.

Specific examples of the surfactant include: water-soluble polymers such as polyvinyl alcohol, methylcellulose, carboxymethylcellulose, and sodium polyacrylate; surfactants including anionic surfactants such as sodium dodecylbenzenesulfonate, sodium octadecylsulfate, sodium oleate, sodium laurate, and potassium stearate, cationic surfactants such as laurylamine acetate and lauryltrimethylammonium chloride, amphoteric surfactants such as lauryldimethylamine oxide, and nonionic surfactants such as a polyoxyethylene alkyl ether, a polyoxyethylene alkylphenyl ether, and a polyoxyethylene alkylamine; and inorganic compounds such as tricalcium phosphate, aluminum hydroxide, calcium sulfate, calcium carbonate, and barium carbonate.

It should be noted that one kind thereof may be used alone or two or more kinds thereof may be used in combination, as necessary.

(Wax Dispersion)

A wax dispersion of the present invention is obtained by dispersing a wax in an aqueous medium. The wax dispersion is prepared by a known process.

(Resin Particle Dispersion)

A resin particle dispersion to be used in the present invention is obtained by dispersing resin particles in an aqueous medium.

In the present invention, the aqueous medium means a medium containing water as a main component. Specific examples of the aqueous medium include water itself, water supplemented with a pH adjuster, and water supplemented with an organic solvent.

A resin constituting the resin particles contained in the resin particle dispersion is not particularly limited as long as the resin is suitable for a toner and is preferably a thermoplastic binder resin having a glass transition temperature equal to or lower than a fixation temperature in an electrophotographic apparatus.

Specific examples thereof may include: homopolymers of, or copolymers obtained by combining two or more kinds of, styrenes such as styrene, p-chlorostyrene, and α-methylstyrene, vinyl group-based monomers such as methyl acrylate, ethyl acrylate, n-propyl acrylate, lauryl acrylate, 2-ethylhexyl acrylate, methyl methacrylate, ethyl methacrylate, n-propyl methacrylate, lauryl methacrylate, 2-ethylhexyl methacrylate, acrylonitrile, and methacrylonitrile, vinyl ether-based monomers such as vinyl methyl ether and vinyl isobutyl ether, vinyl ketone-based monomers such as vinyl methyl ketone, vinyl ethyl ketone, and vinyl isopropenyl ketone, and polyolefin-based monomers such as ethylene, propylene, and butadiene, and mixtures of the homopolymers and the copolymers; an epoxy resin, a polyester resin, a polyurethane resin, a polyamide resin, a cellulose resin, a polyether resin, and a non-vinyl condensation resin, mixtures of these resins and the vinyl-based resins, and graft polymers obtained by polymerizing vinyl-based monomers in the presence of these resins. In particular, from the viewpoints of fixability and charging performance of a toner, a polystyrene resin or a polyester resin is particularly preferably used. One kind of those resins may be used alone, or two or more kinds thereof may be used in combination.

The resin particle dispersion to be used in the present invention is obtained by dispersing resin particles in an aqueous medium. The resin particle dispersion is prepared by a known process. For example, in the case of a resin particle dispersion containing resin particles containing as a constituent element a vinyl-based monomer, particularly a styrene-based monomer, the resin particle dispersion may be prepared by subjecting the monomer to emulsion polymerization with a surfactant or the like.

Further, in the case of a resin (e.g., a polyester resin) produced by another process, the resin is dispersed in water together with an ionic surfactant and a polymer electrolyte through the use of a dispersing machine such as a homogenizer. After that, the solvent can be evaporated to produce a resin particle dispersion. Further, the resin particle dispersion may be prepared by a process involving adding a surfactant to a resin, followed by emulsion dispersion in water with a dispersing machine such as a homogenizer, a phase inversion emulsification process, or the like.

The median diameter on a volume basis of the resin particles in the resin particle dispersion is preferably 0.005 to 1.0 μm, more preferably 0.01 to 0.4 μm. When the median diameter is 1.0 μm or more, it becomes difficult to obtain toner particles having a weight-average particle diameter of 3.0 to 7.5 μm as appropriate toner particles.

The average particle diameter of the resin particles may be measured, for example, by a dynamic light scattering process (DLS), a laser scattering process, a centrifugal sedimentation process, a field-flow fractionation process, or an electrical sensing zone process. It should be noted that the average particle diameter in the present invention means a 50% cumulative particle diameter value (D50) on a volume basis, which is measured by a dynamic light scattering process (DLS)/laser Doppler process at 20° C. and at a solid concentration of 0.01 mass % as described later, unless otherwise stated.

(Coloring Agent Particle Dispersion)

A coloring agent particle dispersion of the present invention is obtained by dispersing a coloring agent in an aqueous medium together with a surfactant. Coloring agent particles are dispersed by a known process, and for example, a medium type dispersing machine such as a rotation shearing type homogenizer, a ball mill, a sand mill, or an attritor, or a high-pressure counter collision type dispersing machine is preferably used.

The amount of the surfactant to be used is 0.01 to 10 parts by mass, preferably 0.1 to 5.0 parts by mass, with respect to 100 parts by mass of the coloring agent. The surfactant is particularly preferably used at 0.5 part by mass to 3.0 parts by mass because the removal of the surfactant in the toner particles becomes easy. As a result, the amount of the surfactant remaining in the resultant toner becomes small, resulting in such effects that the image density of the toner is high and fogging hardly occurs.

(Aggregation Step)

A process for forming aggregate particles is not particularly limited and may be suitably exemplified by a process involving adding and mixing a pH adjuster, a flocculant, a stabilizer, and the like into the above-mentioned mixed liquid and appropriately applying a temperature, mechanical power (stirring), and the like.

The pH adjuster of the present invention is not particularly limited and examples thereof include alkalis such as ammonia and sodium hydroxide and acids such as nitric acid and citric acid.

The flocculant of the present invention is not particularly limited and examples thereof include divalent or higher valent metal complexes as well as inorganic metal salts such as sodium chloride, magnesium carbonate, magnesium chloride, magnesium nitrate, magnesium sulfate, calcium chloride, and aluminum sulfate.

Examples of the stabilizer of the present invention mainly include surfactants.

The surfactants are not particularly limited and examples thereof include: water-soluble polymers such as polyvinyl alcohol, methylcellulose, carboxymethylcellulose, and sodium polyacrylate; surfactants including anionic surfactants such as sodium dodecylbenzenesulfonate, sodium octadecylsulfate, sodium oleate, sodium laurate, and potassium stearate, cationic surfactants such as laurylamine acetate and lauryltrimethylammonium chloride, amphoteric surfactants such as lauryldimethylamine oxide, and nonionic surfactants such as a polyoxyethylene alkyl ether, a polyoxyethylene alkylphenyl ether, and a polyoxyethylene alkylamine; and inorganic compounds such as tricalcium phosphate, aluminum hydroxide, calcium sulfate, calcium carbonate, and barium carbonate. It should be noted that one kind of those stabilizers may be used alone, or two or more kinds thereof may be used in combination as necessary.

The average particle diameter of the aggregation particles to be formed in this step is not particularly limited but is generally recommended to be controlled to one similar to the average particle diameter of toner particles to be obtained. The control may be easily performed, for example, by appropriately setting and changing a temperature at the time of the addition and mixing of the flocculant and the like and conditions for the above-mentioned mixing with stirring. In addition, in order to prevent the toner particles from being fused to each other, the pH adjuster, the surfactant, and the like may be appropriately loaded.

(Fusion Step)

In a fusion step, the aggregate particles are fused by heating to form toner particles.

A temperature for the heating has only to fall within a range from the glass transition temperature (Tg) of a resin contained in the aggregate particles to the decomposition temperature of the resin. For example, under stirring in the same manner as in the aggregation step, the progress of the aggregation is stopped by the addition of a surfactant, the adjustment of a pH, and the like, and the aggregate particles are caused to fuse and coalesce by heating to a temperature equal to or higher than the glass transition temperature of the resin in the resin particles.

A time for the heating has only to be such a time that the fusion is sufficiently caused. Specifically, the heating has only to be performed for about 10 minutes to 10 hours.

Further, a step including adding and mixing a fine particle dispersion, which is obtained by dispersing fine particles, to allow the fine particles to adhere to the aggregate particles, thereby forming a core-shell structure (adhesion step) may be further included before or after the fusion step.

(Washing Step)

In the present invention, the toner particles obtained after the fusion step are subjected to washing, filtration, drying, and the like under appropriate conditions to yield toner particles. In this case, it is preferred to sufficiently wash the toner particles in order to ensure charging property and reliability sufficient as a toner.

A washing process is not limited, and for example, a suspension containing toner particles is filtered, and the resultant filtration residue is washed by stirring with distilled water and further filtered. From the viewpoint of charging property of a toner, the washing is repeated until the electrical conductivity of the filtrate reaches 150 μS/cm or less. When the electrical conductivity is more than 150 μS/cm, the charging property of a toner lowers, with the result that defects such as fogging and a reduction in image density occur.

(Drying Step)

Drying may be performed by a generally known process such as a vibration type fluidized drying process, a spray dry process, a lyophilization process, or a flash jet process. The moisture content of the toner particles after the drying is preferably 1.5 mass % or less, more preferably 1.0 mass % or less.

In the toner of the present invention, a charge controlling agent may also be mixed with toner base particles before use, as necessary. This allows the control of an optimal tribocharging amount depending on a development system.

<Manufacturing Process for Liquid Developer>

Hereinafter, a manufacturing process for a liquid developer is described as the manufacturing process of the present invention.

First, the liquid developer of the present invention is manufactured by dispersing or dissolving a colored resin powder, and as necessary, a charge controlling agent, a wax, and other aids in an electrical insulating carrier liquid. Alternatively, the liquid developer may be prepared by a double-stage process involving first preparing a concentrated toner and diluting the toner with an electrical insulating carrier liquid to prepare a developer.

A dispersing machine to be used in the present invention is not particularly limited, and for example, a medium type dispersing machine such as a rotation shearing type homogenizer, a ball mill, a sand mill, or an attritor, or a high-pressure counter collision type dispersing machine is preferably used.

A known coloring agent such as a pigment or a dye may be further added alone or two or more kinds thereof may be further added in combination to the colored resin powder of the present invention before use.

The wax and the coloring agent to be used in the present invention are the same as described above.

The charge controlling agent to be used in the present invention is not particularly limited as long as it is used for a liquid developer for electrostatic charge development, and examples thereof include cobalt naphthenate, copper naphthenate, copper oleate, cobalt oleate, zirconium octylate, cobalt octylate, sodium dodecylbenzenesulfonate, calcium dodecylbenzenesulfonate, soybean lecithin, and aluminum octoate.

The electrical insulating carrier liquid to be used in the present invention is not particularly limited, and for example, an organic solvent having as high an electrical resistance as $10^9$ Ω·cm or more and as low a dielectric constant as 3 or less is preferably used.

Preferred specific examples thereof include ones having a boiling point within a temperature range of 68 to 250° C. including an aliphatic hydrocarbon solvent such as hexane, pentane, octane, nonane, decane, undecane, or dodecane, ISOPAR H, G, K, L, or M (manufactured by Exxon Mobil Corporation), and LINEALENE DIMER A-20 or A-20H (manufactured by Idemitsu Kosan Co., Ltd.). They may be used alone or in combination of two or more kinds thereof in such a range that the viscosity of a system does not become high.

EXAMPLES

Hereinafter, the present invention is described in more detail by way of examples and comparative examples. However, the present invention is not limited to these examples. It should be noted that the terms "part(s)" and "%" in the following description refer to "part(s) by mass" and "mass %" unless otherwise stated.

The resultant reaction products were identified by multiple analysis processes using the following devices. That is, the following analysis devices were used: a 1H nuclear magnetic resonance spectrometer (ECA-400, manufactured by JEOL Ltd.); an LC/TOF MS (LC/MSD TOF, manufactured by Agilent Technologies); and a UV/Vis spectrophotometer (UV-36000 type spectrophotometer, Shimadzu Corporation). It should be noted that an electrospray ionization process (ESI) was applied as an ionization process in the LC/TOF MS.

(Manufacture of Compound Represented by General Formula (1))

The compound represented by the general formula (1) of the present invention may be synthesized by a known process.

The compound represented by the general formula (1) of the present invention was manufactured by a process to be described below.

Synthesis Example 1

Manufacturing Example of Compound (1)

10.4 g (80 mmol) of ethyl acetoacetate and 0.7 g (6.4 mmol) of sodium carbonate were suspended in a solution of 14.3 g (40 mmol) of 4-bromo-1-butylaminoanthraquinone in mL of 1,2-dichlorobenzene, and the suspension was stirred at 175° C. for 24 hours. After the completion of the reaction, the resultant was cooled to room temperature and then diluted with 50 mL of 2-propyl alcohol and 50 mL of hexane. The solid was filtered and then washed with 100 mL of 2-propyl alcohol. After that, 8 g of an intermediate (1) corresponding to the compound C were obtained. To a solution of 7 g (14.6 mmol) of the intermediate (1) in 75 mL of dimethylformamide were added 3.6 mL of 2-ethylhexylamine, 292 mg of copper(I) iodide, and 4.7 g of sodium carbonate, and the mixture was subjected to a reaction at 100° C. for 2 hours. After the completion of the reaction, the resultant was cooled and diluted with 200 mL of ethyl acetate, followed by filtration. The filtration residue was purified by column chromatography (toluene/THF) to yield 5.7 g (30% yield) of a compound (1). FIG. 1 shows a $^1$H NMR spectrum at 400 MHz of the compound (1) in $CDCl_3$ at room temperature.

Further, the solubility of the compound in water at room temperature and 60° C. was confirmed. As a result, the solubility was found to be less than 1% in terms of mass percentage.

(Results of Analysis of Compound (1))

[1] $^1$H NMR (400 MHz, $CDCl_3$, room temperature): δ [ppm]=0.97 (tt, 9H, J=20.6, 7.25 Hz), 1.32 (td, 4H, J=15.0, 14.2 Hz), 1.62-4.46 (m, 6H), 1.74-1.83 (m, 3H), 2.73 (s, 3H), 3.36 (m, 2H), 4.40 (t, 2H, J=7.79 Hz), 7.28 (d, 2H, J=9.62 Hz), 7.61-7.70 (m, 3H), 8.03 (d, 1H, J=7.79 Hz), 8.59 (dd, 1H, J=7.79, 1.83 Hz), 10.8 (s, 1H)

[2] Mass Spectrometry (ESI-TOF): m/z=473.2898 (M+H)+

[3] UV/Vis Spectroscopy: λmax=556 nm

Synthesis Example 2

Manufacturing Example of Compound (4)

6.8 g (32% yield) of a compound (4) were obtained by the same operation as in the manufacturing example 1 except that, in the manufacturing example 1, ethyl acetoacetate was changed to ethyl benzoylacetate.

Further, the solubility of the compound in water at room temperature and 60° C. was confirmed. As a result, the solubility was found to be less than 1% in terms of mass percentage.

(Results of Analysis of Compound (4))

[1] $^1$H NMR (400 MHz, $CDCl_3$, room temperature): δ [ppm]=0.96 (dt, 9H, J=25.0, 7.21 Hz), 1.36-1.39 (m, 4H), 1.45-1.61 (m, 6H), 1.79 (t, 3H, J=6.18 Hz), 3.37-3.41 (m, 2H), 4.39 (s, 2H), 7.32-7.47 (m, 4H), 4.75 (tt, 2 Hz, J=7.56, 2.44 Hz), 7.72 (d, 1H, J=10.1 Hz), 7.97-8.03 (m, 3H), 8.55 (dd, 1H, J=7.79, 1.37 Hz), 10.9 (s, 1H)

[2] Mass spectrometry (ESI-TOF): m/z=535.3001 $(M+H)^+$

[3] UV/Vis spectroscopy: λmax=558 nm

Synthesis Example 3

Manufacturing Example of Compound (6)

5.4 g (24% yield) of a compound (6) were obtained by the same operation as in the manufacturing example 1 except that, in the manufacturing example 1, ethyl acetoacetate was changed to ethyl 4-methoxybenzoylacetate.

Further, the solubility of the compound in water at room temperature and 60° C. was confirmed. As a result, the solubility was found to be less than 1% in terms of mass percentage.

(Results of Analysis of Compound (6))

[1] $^1$H NMR (400 MHz, $CDCl_3$, room temperature): δ [ppm]=0.90 (dt, 9H, J=24.9, 7.21 Hz), 1.31 (t, 4H, J=3.66 Hz), 1.44 (dd, 4H, J=14.9, 7.56 Hz), 1.52 (dd, 2H, J=16.5, 7.33 Hz), 1.73 (t, 3H, J=6.18 Hz), 3.78 (s, 1H), 4.33 (d, 2H, 43.1 Hz), 6.86 (d, 2H, J=9.16 Hz), 7.24 (t, 1H, J=11.5 Hz), 7.34 (t, 1H, J=7.79 Hz), 7.51 (t, 1H, J=7.56 Hz), 7.65 (d, 1H, J=9.62 Hz), 7.92 (d, 2H, J=8.70 Hz), 8.01 (d, 1H, J=8.24 Hz), 10.8 (s, 1H)

[2] Mass spectrometry (ESI-TOF): m/z=565.3048 $(M+H)^+$
[3] UV/Vis spectroscopy: λmax=557 nm Synthesis Example 4

Manufacturing Example of Compound (8)

3.9 g (17% yield) of a compound (8) were obtained by the same operation as in the manufacturing example 1 except that, in the manufacturing example 1,4-bromo-1-butylaminoanthraquinone was changed to 4-bromo-1-(2-ethylhexyl) aminoanthraquinone and ethyl acetoacetate was changed to ethyl benzoylacetate.

Further, the solubility of the compound in water at room temperature and 60° C. was confirmed. As a result, the solubility was found to be less than 1% in terms of mass percentage.

(Results of Analysis of Compound (8))

[1] $^1$H NMR (400 MHz, $CDCl_3$, room temperature): δ [ppm]=0.88 (dq, 12H, J=41.1, 10.1 Hz), 1.19-1.34 (m, 12H), 1.49 (dt, 4H, J=22.3, 8.24 Hz), 1.74 (t, 1H, J=6.18 Hz), 1.91 (s, 1H), 3.32 (t, 2H, J=4.12 Hz), 4.34 (br, 2H), 7.24 (t, 1H, J=10.3 Hz), 7.32-7.42 (m, 3H), 7.50-7.54 (m, 2H), 7.67 (d, 1H, J=9.62 Hz), 7.95 (dd, 3H, J=15.1, 7.79 Hz), 8.50 (d, 1H, J=6.87 Hz), 10.8 (s, 1H)

[2] Mass spectrometry (ESI-TOF): m/z=591.3567 $(M+H)^+$
[3] UV/Vis spectroscopy: λmax=559 nm Synthesis Example 5

Manufacturing Example of Compound (9)

4.6 g (21% yield) of a compound (9) were obtained by the same operation as in the manufacturing example 1 except that, in the manufacturing example 1,4-bromo-1-butylaminoanthraquinone was changed to 4-bromo-1-(2-ethylhexyl) aminoanthraquinone and ethyl acetoacetate was changed to diethyl malonate.

Further, the solubility of the compound in water at room temperature and 60° C. was confirmed. As a result, the solubility was found to be less than 1% in terms of mass percentage.

(Results of Analysis of Compound (9))

[1] $^1$H NMR (400 MHz, $CDCl_3$, room temperature): δ [ppm]=0.90 (tt, 12H, J=19.0, 7.02 Hz), 1.23-1.55 (m, 19H), 1.74 (t, 1H, J=6.18 Hz), 1.93 (d, 1H, J=3.66 Hz), 3.32 (s, 2H), 4.38 (d, 2H, J=23.8 Hz), 4.54 (q, 2H, J=6.72 Hz), 7.23 (d, 1H, J=9.62 Hz), 7.64 (dq, 3H, J=16.3, 4.73 Hz), 8.19 (d, 1H, J=7.79 Hz), 8.55 (t, 1H, J=4.58 Hz), 10.8 (s, 1H)

[2] Mass spectrometry (ESI-TOF): m/z=559.3497 $(M+H)^+$
[3] UV/Vis spectroscopy: λmax=559 nm Synthesis Example 6

Manufacturing Example of Compound (10)

5.2 g (22% yield) of a compound (10) were obtained by the same operation as in the manufacturing example 1 except that, in the manufacturing example 1,4-bromo-1-butylaminoanthraquinone was changed to 4-bromo-1-(2-ethylhexyl) aminoanthraquinone, ethyl acetoacetate was changed to ethyl benzoylacetate, ethyl acetoacetate was changed to diethyl malonate, and 2-ethylhexylamine was changed to 3-butoxypropylamine.

Further, the solubility of the compound in water at room temperature and 60° C. was confirmed. As a result, the solubility was found to be less than 1% in terms of mass percentage.

(Results of Analysis of Compound (10))

[1] $^1$H NMR (400 MHz, $CDCl_3$, room temperature): δ [ppm]=0.84-0.94 (m, 9H), 1.24-1.42 (m, 10H), 1.58 (td, 2H, J=14.3, 7.48 Hz), 1.93 (s, 1H), 2.02-2.08 (m, 2H), 3.45 (t, 2H, J=6.64 Hz), 3.58 (q, 4H, J=6.72 Hz), 4.37 (br, 2H), 7.32-7.45 (m, 4H), 7.53-7.57 (m, 2H), 7.70 (d, 1H, J=9.62 Hz), 7.98 (dd, 3H, J=18.3, 7.79 Hz), 8.51 (d, 1H, J=6.41 Hz), 10.8 (s, 1H) [2] Mass spectrometry (ESI-TOF): m/z=593.3361 $(M+H)^+$ [3] UV/Vis spectroscopy: λmax=555 nm Synthesis Example 7

Manufacturing Example of Compound (14)

5.0 g (25% yield) of a compound (10) were obtained by the same operation as in the manufacturing example 1 except that, in the manufacturing example 1,4-bromo-1-butylaminoanthraquinone was changed to 4-bromo-1-methylaminoanthraquinone and ethyl acetoacetate was changed to ethyl benzoylacetate.

Further, the solubility of the compound in water at room temperature and 60° C. was confirmed. As a result, the solubility was found to be less than 1% in terms of mass percentage.

(Results of Analysis of Compound (14))

[1] $^1$H NMR (400 MHz, $CDCl_3$, room temperature): δ [ppm]=0.91 (t, 3H, J=6.87 Hz), 0.97 (t, 3H, J=7.56 Hz), 1.34 (t, 4H, J=3.66 Hz), 1.52 (m, 4H), 1.77 (t, 1H, 6.18 Hz), 3.35 (t, 2H, J=4.35 Hz), 3.84 (s, 3H), 7.30 (d, 1H, J=9.62 Hz), 7.40 (td, 3H, J=15.2, 7.94 Hz), 7.55 (t, 2H, J=7.10 Hz), 7.72 (d, 1H, J=9.62 Hz), 7.98 (dd, 3H, J=10.7, 8.70 Hz), 8.53 (d, 1H, J=7.79 Hz), 10.8 (s, 1H)

[2] Mass spectrometry (ESI-TOF): m/z=493.2504 $(M+H)^+$
[3] UV/Vis spectroscopy: λmax=560 nm Synthesis Example 8

Manufacturing Example of Compound (15)

6.8 g (30% yield) of a compound (15) were obtained by the same operation as in the manufacturing example 1 except that, in the manufacturing example 1, ethyl acetoacetate was changed to ethyl benzoylacetate and 2-ethylhexylamine was changed to cyclohexylamine.

Further, the solubility of the compound in water at room temperature and 60° C. was confirmed. As a result, the solubility was found to be less than 1% in terms of mass percentage.

(Results of Analysis of Compound (15))

[1] $^1$H NMR (400 MHz, $CDCl_3$, room temperature): δ [ppm]=0.87 (t, 6H, J=11.0 Hz), 1.24-1.66 (m, 14H), 1.88 (s, 3H), 2.10 (s, 2H), 3.68 (s, 1H), 4.37 (s, 1H), 7.36 (dq, 4H, J=32.9, 8.93 Hz), 7.55 (dd, 2H, J=10.3, 4.81 Hz), 7.68 (d, 1H, J=9.62 Hz), 7.95-8.00 (m, 3H), 8.52 (d, 1H, J=6.41 Hz), 10.9 (d, 1H, J=7.79 Hz), 10.9 (d, 1H, J=7.79 Hz)

[2] Mass spectrometry (ESI-TOF): m/z=561.3055 $(M+H)^+$
[3] UV/Vis spectroscopy: λmax=547 nm Synthesis Example 9

Manufacturing Example of Compound (20)

15.3 mL (40 mmol) of ethyl 4-methoxybenzoylacetate and 0.7 g (6.4 mmol) of sodium carbonate were suspended in a solution of 14 g (40 mmol) of 1,4-dibutylaminoanthracene-9,10-dione in 40 mL of 1,2-dichlorobenzene, and the suspension was stirred at 175° C. for 24 hours. After the completion of the reaction, the resultant was cooled to room temperature and then purified by column chromatography (hexane/ethyl acetate) to yield 4.8 g (24% yield) of a compound (20).

Further, the solubility of the compound in water at room temperature and 60° C. was confirmed. As a result, the solubility was found to be less than 1% in terms of mass percentage.

(Results of Analysis of Compound (20))

[1] $^1$H NMR (400 MHz, $CDCl_3$, room temperature): δ [ppm]=0.96 (dt, 6H, J=16.6, 7.44 Hz), 1.48 (dq, 4H, J=29.7, 7.48 Hz), 1.73-1.81 (m, 4H), 3.41 (dd, 2H, J=11.9, 6.87 Hz), 3.79 (s, 3H), 4.34 (d, 1H, J=44.4 Hz), 6.87 (d, 2H, J=9.16 Hz), 7.25 (d, 1H, J=9.62 Hz), 7.35 (t, 1H, J=6.87 Hz), 7.52 (t, 1H, J=7.56 Hz), 7.35 (t, 1H, J=6.87 Hz), 7.52 (t, 1H, J=7.56 Hz), 7.66 (d, 1H, J=9.62 Hz), 7.93 (d, 2H, J=8.70 Hz), 8.01 (d, 1H, J=8.24 Hz), 8.48 (d, 1H, J=6.41 Hz), 10.7 (s, 1H)

[2] Mass spectrometry (ESI-TOF): m/z=509.2389 $(M+H)^+$

[3] UV/Vis spectroscopy: λmax=555 nm

Synthesis Example 10

Manufacturing Example of Compound (21)

8.5 g (45% yield) of a compound (21) were obtained by the same operation as in the manufacturing example 9 except that, in the manufacturing example 9, ethyl 4-methoxybenzoylacetate was changed to ethyl benzoylacetate.

Further, the solubility of the compound in water at room temperature and 60° C. was confirmed. As a result, the solubility was found to be less than 1% in terms of mass percentage.

(Results of Analysis of Compound (21))

[1] $^1$H NMR (400 MHz, $CDCl_3$, room temperature): δ [ppm]=0.99 (dt, 6H, J=18.3, 7.33 Hz), 1.44-1.58 (m, 4H), 1.80 (dd, 4H, J=14.7, 7.33 Hz), 3.45 (d, 2H, J=5.50 Hz), 4.36 (br, 2H), 7.30 (d, 1H, J=9.62 Hz), 7.37 (t, 1H, J=7.79 Hz), 7.43 (t, 2H, J=7.79 Hz), 7.55 (t, 2H, J=5.72 Hz), 7.70 (d, 1H, J=9.62 Hz), 7.98 (dd, 3H, J=16.9, 7.79 Hz), 8.52 (d, 1H, J=9.62 Hz), 10.8 (s, 1H)

[2] Mass spectrometry (ESI-TOF): m/z=479.2304 $(M+H)^+$

[3] UV/Vis spectroscopy: λmax=556 nm

<Manufacturing Example of Colored Resin Powder (1)>

100 parts of a binder resin (polyester resin) (Tg: 55° C.; acid value: 20 mg KOH/g; hydroxyl value: 16 mg KOH/g; molecular weight: Mp 4,500, Mn 2,300, Mw 38,000) and the compound (1) were mixed well with a Henschel mixer (FM-75J type, manufactured by NIPPON COKE & ENGINEERING Co., LTD.) and then kneaded with a twin-screw kneading machine (PCM-45 type, manufactured by Ikegai Corp) set to a temperature of 130° C. at a feed amount of 60 kg/hr (the temperature of the kneaded product at the time of ejection was about 150° C.). The resultant kneaded product was cooled, roughly pulverized with a hammer mill, and then finely pulverized with a mechanical pulverizing machine (T-250: manufactured by FREUND-TURBO CORPORATION) at a feed amount of 20 kg/hr to yield a colored resin powder (1).

<Manufacturing Examples of Colored Resin Powders (2) and (3)>

Colored resin powders (2) and (3) were obtained by the same operation as in the manufacturing example of the colored resin powder (1) except that, in the manufacturing example of the colored resin powder (1), the compound (1) was changed to the compounds (4) and (6), respectively.

<Manufacturing Examples of Comparative Colored Resin Powders (1) and (2)>

Comparative colored resin powders (1) and (2) were obtained by the same operation as in the manufacturing example of the colored resin powder (1) except that, in the manufacturing example of the colored resin powder (1), the compound (1) was changed to comparative compounds (1) and (2), respectively.

Comparative Compound (1)

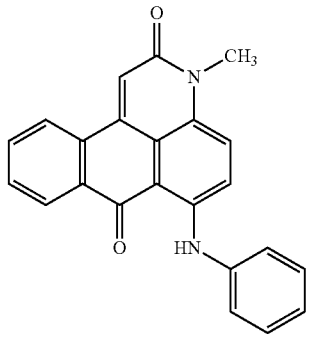

Comparative Compound (2)

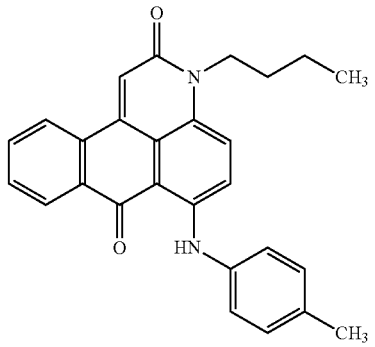

The above-mentioned colored resin powders were evaluated as described below. It should be noted that the evaluation results were shown in Table 2 to be described later.

(Evaluation of Colored Resin Powder for Lightness and Saturation)

Under room temperature, 0.5 g each of the colored resin powders (1) to (3) and the comparative colored resin powders (1) and (2) was dissolved in 4.5 g of tetrahydrofuran, applied onto a hiding power chart by a bar coating process (Bar Nos. 4, 6, 8, 10, 12, 14, 16, 18, and 20), and dried in air overnight to produce an image sample.

An optical density and chromaticity (L*,a*,b*) in an L*a*b* colorimetric system were measured with SpectroLino manufactured by Gretag Macbeth.

In an Lab space, a higher value for chromaticity in a magenta gamut direction at a predetermined value for L* indicates spectral reflectance characteristic having a wider gamut. An evaluation was made with values for a* and b* at L* of 55.

A: a* of 75 or more and b* of −15 or less (very wide gamut)

B: a* of 60 or more and less than 75 and b* of −15 or less (wide gamut)

C: a* of less than 60 and b* of −15 or less (narrow gamut)

In addition, a larger value for C* indicates more satisfactory saturation. Hence, the following evaluation was made.

A: C* of 80 or more (very excellent in saturation)

B: C* of 70 or more and less than 80 in terms of improvement ratio (excellent in saturation)

C: C* of less than 70 (poor in saturation)

$$C^*=\{(a^*)^2+(b^*)^2\}^{1/2}$$

TABLE 2

Evaluation results of colored resin powder

| | Compound number | a*/b*/color tone evaluation at L* = 55 | c*/saturation evaluation |
|---|---|---|---|
| Colored resin powder (1) | Compound (1) | 78.6/−24.6/A | 82.3/A |
| Colored resin powder (2) | Compound (4) | 82.1/−29.3/A | 87.2/A |
| Colored resin powder (3) | Compound (6) | 81.1/−24.8/A | 84.8/A |
| Comparative colored resin powder (1) | Comparative compound (1) | 37.5/−17.5/C | 41.4/C |
| Comparative colored resin powder (2) | Comparative compound (2) | 42.9/−18.8/C | 46.9/C |

As apparent from Table 2, the colored resin powders obtained in the present invention have high lightness and saturation and spectral reflectance characteristic having a wide gamut as compared to the comparative colored resin powders.

<Manufacturing Example of Resin Particle Dispersion (1)>

82.6 parts of styrene, 9.2 parts of n-butyl acrylate, 1.3 parts of acrylic acid, 0.4 part of hexanediol acrylate, and 3.2 parts of n-laurylmercaptan were mixed and dissolved. To the solution was added an aqueous solution of 1.5 parts of NEOGEN RK (manufactured by Dai-ichi Kogyo Seiyaku Co., Ltd.) in 150 parts of deionized water, followed by dispersion. Then, an aqueous solution of 0.15 part of potassium persulfate in 10 parts of deionized water was added while the dispersion was slowly stirred for 10 minutes. After purging with nitrogen, the mixture was subjected to emulsion polymerization at 70° C. for 6 hours. After the completion of the polymerization, the reaction liquid was cooled to room temperature and supplemented with deionized water to yield a resin particle dispersion (1) having a solid concentration of 12.5 mass % and a median diameter on a volume basis of 0.2 μm.

<Manufacturing Example of Resin Particle Dispersion (2)>

A resin particle dispersion (2) was obtained by the same process as in the manufacturing example of the resin particle dispersion (1) with the exception that, in the manufacturing example of the resin particle dispersion (1), a solution obtained by further adding and dissolving 5 parts of the compound (1) was used as a raw material.

<Manufacturing Example of Coloring Agent Particle Dispersion (1)>

100 parts of the compound (1) and 15 parts of NEOGEN RK were mixed into 885 parts of deionized water, and dispersed with a wet jet mill JN100 (manufactured by JOKOH CO., LTD.) for about 1 hour to yield a coloring agent particle dispersion (1). The median diameter on a volume basis of coloring agent particles in the coloring agent particle dispersion was 0.2 μm and the concentration of the coloring agent particles was 10 mass %.

<Manufacturing Example of Wax Dispersion>

100 parts of an ester wax (peak temperature of the maximum endothermic peak in DSC measurement=70° C., Mn=704) and 15 parts of NEOGEN RK were mixed into 385 parts of deionized water and dispersed with a wet jet mill JN100 (manufactured by JOKOH CO., LTD.) for about 1 hour to yield a wax dispersion (1). The concentration of the wax particle dispersion was 20 mass %.

(Manufacture of Toner)

The toner of the present invention and toners for comparison were manufactured by processes described below.

Example 1

160 parts of the resin particle dispersion (1), 10 parts of the coloring agent particle dispersion (1), 10 parts by mass of the wax dispersion (1), and 0.2 part of magnesium sulfate were dispersed with a homogenizer (manufactured by IKA: ULTRA-TURRAX T50) and then heated to 65° C. with stirring. After stirring at 65° C. for 1 hour, the resultant was observed with a light microscope. As a result, it was found that aggregate particles having an average particle diameter of about 6.0 μm were formed. 2.2 parts of NEOGEN RK (manufactured by Dai-ichi Kogyo Seiyaku Co., Ltd.) were added and then the mixture was heated to 80° C. and stirred for 120 minutes to yield fused spherical toner particles. After cooling, the resultant was filtered. The solid separated by the filtration was washed by stirring with 720 parts of deionized water for 60 minutes. The solution containing toner particles was filtered, and washing was repeated in the same manner as described above until the electrical conductivity of the filtrate reached 150 μS/cm or less. The toner particles were dried with a vacuum drying machine to yield toner base particles (1).

It should be noted that the electrical conductivity of the filtrate was calculated according to Japanese Patent Application Laid-Open No. 2006-243064. That is, 30 parts of the initial filtrate were discarded, the remainder was set to a temperature of 25±0.5° C., and then the electrical conductivity of the filtrate was measured with an electrical conductivity meter (manufactured by HORIBA, Ltd.: ES-12). The electrical conductivity of a sample was calculated with the following equation.

(Equation): Electrical conductivity (μS/cm)=A−B

A: Electrical conductivity of filtrate

B: Electrical conductivity of water used for washing

It should be noted that the deionized water used was one having an electrical conductivity of 5 μS/cm or less and a pH of 7.0±1.0.

Example 2

170 parts of the resin particle dispersion (2), 10 parts by mass of the wax dispersion (1), and 0.2 part of magnesium sulfate were dispersed with a homogenizer (manufactured by IKA: ULTRA-TURRAX T50) and then heated to 65° C. with stirring. After stirring at 65° C. for 1 hour, the resultant was observed with a light microscope. As a result, it was found that aggregate particles having an average particle diameter of about 6.0 μm were formed. 2.2 parts of NEOGEN RK (manufactured by Dai-ichi Kogyo Seiyaku Co., Ltd.) were added and then the mixture was heated to 80° C. and stirred for 120 minutes to yield fused spherical toner particles. After cooling, the resultant was filtered. The solid separated by the filtration was washed by stirring with 720 parts of deionized water for 60 minutes. The solution containing toner particles was filtered, and washing was repeated in the same manner as described above until the electrical conductivity of the filtrate reached 150 μS/cm or less. The toner particles were dried with a vacuum drying machine to yield toner base particles (2).

Example 3

100 parts by mass of a binder resin (polyester resin) (Tg: 55° C.; acid value: 20 mg KOH/g; hydroxyl value: 16 mg KOH/g; molecular weight: Mp: 4,500, Mn: 2,300, Mw: 38,000), 5 parts by mass of the compound (1), 0.5 part by mass of an aluminum 1,4-di-t-butylsalicylate compound, and 5 parts by mass of a paraffin wax (maximum endothermic peak temperature: 78° C.) were mixed well with a Henschel mixer (FM-75J type, manufactured by NIPPON COKE & ENGINEERING Co., LTD.) and then kneaded with a twin-screw kneading machine (PCM-45 type, manufactured by Ikegai Corp) set to a temperature of 130° C. at a feed amount of 60 kg/hr (the kneaded product at the time of ejection had a temperature of about 150° C.). The resultant kneaded product was cooled, roughly pulverized with a hammer mill, and then finely pulverized with a mechanical pulverizing machine (T-250: manufactured by FREUND-TURBO CORPORATION) at a feed amount of 20 kg/hr.

The resultant toner finely pulverized product was further classified with a multi-division classifying machine utilizing the Coanda effect to yield toner base particles (3).

The resultant toner base particles (3) had a weight-average particle diameter (D4) of 6.0 μm and contained 30.2 number % of particles having a particle diameter of 4.0 μm or less and 0.6 volume % of particles having a particle diameter of 10.1 μm or more.

Examples 4 to 7

Coloring agent particle dispersions were prepared in the same manner as in the manufacturing example of the coloring agent particle dispersion (1) except that the compound (1) was not used but changed to the compounds (4), (6), (9), and (15), respectively. Toner base particles (4), (7), (11), and (14) were obtained by the same operation as in Example 1 through the use of the resultant coloring agent particle dispersions.

Examples 8 to 11

Resin particle dispersions were prepared in the same manner as in the manufacturing example of the resin particle dispersion (2) except that the compound (1) was not used but changed to the compounds (4), (6), (10), and (20), respectively. Toner base particles (5), (8), (12), and (15) were obtained by the same operation as in Example through the use of the resultant resin particle dispersions.

Examples 12 to 16

Toner base particles (6), (9), (10), (13), and (16) were obtained in the same manner as in Example 3 except that the compound (1) was not used but changed to the compounds (4), (6), (8), (14), and (21) shown in Table 1, respectively.

Comparative Examples 1 and 2

Coloring agent particle dispersions were prepared in the same manner as in the manufacturing example of the coloring agent particle dispersion (1) except that the compound (1) was not used but changed to the comparative compounds (1) and (2), respectively. Comparative toner base particles (1) and (4) were obtained by the same operation as in Example 1 through the use of the resultant coloring agent particle dispersions.

Comparative Examples 3 and 4

Resin particle dispersions were prepared in the same manner as in the manufacturing example of the resin particle dispersion (2) except that the compound (1) was not used but changed to the comparative compounds (1) and (2), respectively. Comparative toner base particles (2) and (5) were obtained by the same operation as in Example 2 through the use of the resultant resin particle dispersions.

Comparative Examples 5 and 6

Comparative toner base particles (3) and (6) were obtained in the same manner as in Example 3 except that the compound (1) was not used but changed to the comparative compounds (1) and (2), respectively.

100 parts each of the above-mentioned toner base particles and toner base particles for comparison were dry-mixed with 1.8 parts of hydrophobically treated silica fine powder having a specific surface area, which was measured by a BET process, of 200 $m^2/g$ with a Henschel mixer (manufactured by NIPPON COKE & ENGINEERING Co., LTD.) to yield toners (1) to (16) and toners for comparison (1) to (6), respectively.

The above-mentioned toners were evaluated as described below. It should be noted that the evaluation results were shown in Table 3 to be described later.

(Measurement of Toner for Weight-Average Particle Diameter D4 and Number-Average Particle Diameter D1)

The number-average particle diameter (D1) and weight-average particle diameter (D4) of the above-mentioned toner particles were measured by particle size distribution analysis based on a Coulter process. Coulter Counter TA-II or Coulter Multisizer II (manufactured by Beckman Coulter, Inc.) was used as a measurement device, and the measurement was performed according to the instruction manual of the device. As an electrolytic solution, first grade sodium chloride was used to prepare an aqueous solution containing about 1% of sodium chloride. For example, ISOTON-II (manufactured by Coulter Scientific Japan) may be used. As a specific measurement process, to 100 to 150 ml of the electrolytic aqueous solution are added 0.1 to 5 ml of a surfactant (preferably an alkylbenzene sulfonate) as a dispersant and are further added 2 to 20 mg of a measurement sample (toner particles). The electrolytic solution in which the sample is suspended is subjected to dispersion treatment with an ultrasonic disperser for about 1 to 3 minutes. The resultant dispersion-treated liquid is measured for its volume and number of toner particles having a diameter of 2.00 μm or more with the measurement device equipped with a 100-μm aperture as an aperture, to thereby calculate the volume distribution and number distribution of the toner. Then, the number-average particle diameter (D1) and weight-average particle diameter (D4) of the toner (median for each channel is defined as a representative value for each channel) and D4/D1 are determined.

Used as the channels are the following thirteen channels: 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm, and 32.00 to 40.30 μm. Further, as apparent from Table 1, the ratios of coarse powder and fine powder were found to be increased in Comparative Examples as compared to Examples.

(Measurement of Average Circularity of Toner)

Measurement was performed using a flow-type particle image measuring apparatus "FPIA-2100" (manufactured by Sysmex Corporation). The average circularity of toner was calculated using the following equations.

$$\text{Area-equivalent circle diameter}=\sqrt{\text{Partideprojectedarea}/\pi\times 2}$$

$$\text{Circularity}=\text{Circumferential length of circle having same area as particle projected area}/\text{Circumferential length of particle projected image}$$

In the equations, the term "particle projected area" refers to the area of a binarized toner particle image, and the term "circumferential length of particle projected image" is defined as the length of a borderline obtained by connecting the edge points of the toner particle image. The circularity is an indicator for the degree of surface unevenness of a particle. The circularity is 1.000 when the particle is of a completely spherical shape. As the surface shape of the particle becomes more complicated, the circularity becomes lower.

(Evaluation of Image Sample for Lightness and Saturation)

Image samples were output with the resultant toners and evaluated for their lightness and saturation. It should be noted that, in the comparison of image properties, a paper-feeding test using a remodeled machine of LBP-5300 (manufactured by Canon Inc.) as an image-forming apparatus (hereinafter, abbreviated as LBP) was performed. The remodeling was performed as follows: a developing blade in a process cartridge (hereinafter, referred to as CRG) was exchanged to an SUS blade having a thickness of 8 (μm); and the application of a blade bias of −200 (V) with respect to a developing bias to be applied to a developing roller as a toner bearing member was made possible.

An optical density and chromaticity (L*,a*,b*) in an L*a*b* colorimetric system were measured with SpectroLino manufactured by Gretag Macbeth.

In an Lab space, a higher value for chromaticity in a magenta gamut direction at a predetermined value for L* indicates spectral reflectance characteristic having a wider gamut. An evaluation was made with values for a* and b* at L* of 55.

A: a* of 75 or more and b* of −15 or less (very wide gamut)

B: a* of 60 or more and less than 75 and b* of −15 or less (wide gamut)

C: a* of less than 60 and b* of −15 or less (narrow gamut)

In addition, a larger value for C* indicates more satisfactory saturation. Hence, the following evaluation was made.

A: C* of 80 or more (very excellent in saturation)

B: C* of 70 or more and less than 80 in terms of improvement ratio (excellent in saturation)

C: C* of less than 70 (poor in saturation)

TABLE 3

Evaluation results of toner

| | Compound Number | Manufacturing process | D50 | D4/D1 | Average circularity | a*/b*/color tone evaluation at L* = 55 | c*/saturation evaluation |
|---|---|---|---|---|---|---|---|
| Toner (1) | Compound (1) | Emulsification aggregation | 5.98 | 1.24 | 0.974 | 76.2/−16.1/A | 77.9/B |
| Toner (2) | Compound (1) | (Co)emulsification aggregation | 6.02 | 1.28 | 0.980 | 77.3/−16.8/A | 79.1/B |
| Toner (3) | Compound (1) | Pulverization | 5.64 | 1.25 | 0.930 | 75.2/−17.1/A | 77.1/B |
| Toner (4) | Compound (4) | Emulsification aggregation | 7.66 | 1.18 | 0.962 | 79.8/−20.8/A | 82.5/A |
| Toner (5) | Compound (4) | (Co)emulsification aggregation | 6.24 | 1.23 | 0.950 | 80.9/−21.5/A | 83.7/A |
| Toner (6) | Compound (4) | Pulverization | 5.61 | 1.17 | 0.933 | 78.4/−20.1/A | 80.9/A |
| Toner (7) | Compound (6) | Emulsification aggregation | 4.63 | 1.28 | 0.984 | 81.0/−18.9/A | 83.2/A |
| Toner (8) | Compound (6) | (Co)emulsification aggregation | 5.23 | 1.18 | 0.988 | 80.0/−19.2/A | 82.3/A |
| Toner (9) | Compound (6) | Pulverization | 6.35 | 1.23 | 0.936 | 77.2/−20.4/A | 79.8/B |
| Toner (10) | Compound (8) | Pulverization | 6.68 | 1.21 | 0.930 | 82.4/−18.2/A | 85.4/A |
| Toner (11) | Compound (9) | Emulsification aggregation | 6.02 | 1.20 | 0.958 | 78.9/−18.8/A | 81.1/A |
| Toner (12) | Compound (10) | (Co)emulsification aggregation | 5.98 | 1.26 | 0.964 | 81.5/−19.4/A | 83.8/A |
| Toner (13) | Compound (14) | Pulverization | 5.29 | 1.19 | 0.938 | 79.5/−22.3/A | 82.6/A |
| Toner (14) | Compound (15) | Emulsification aggregation | 6.33 | 1.31 | 0.979 | 77.8/−21.3/A | 80.7/A |
| Toner (15) | Compound (20) | (Co)emulsification aggregation | 6.81 | 1.26 | 0.981 | 81.3/−19.9/A | 83.7/A |
| Toner (16) | Compound (21) | Pulverization | 6.28 | 1.27 | 0.923 | 80.3/−21.8/A | 83.2/A |
| Comparative Toner (1) | Comparative Compound (1) | Emulsification aggregation | 6.78 | 1.29 | 0.928 | 35.2/−9.0/C | 36.3/C |
| Comparative Toner (2) | Comparative Compound (1) | (Co)emulsification aggregation | 6.88 | 1.34 | 0.956 | 34.9/−10.1/C | 36.3/C |
| Comparative Toner (3) | Comparative Compound (1) | Pulverization | 7.38 | 1.98 | 0.916 | 35.9/−12.2/C | 37.9/C |
| Comparative Toner (4) | Comparative Compound (2) | Emulsification aggregation | 6.64 | 1.37 | 0.956 | 38.0/−10.3/C | 39.4/C |
| Comparative Toner (5) | Comparative Compound (2) | (Co)emulsification aggregation | 6.95 | 1.64 | 0.979 | 37.5/−12.2/C | 39.4/C |
| Comparative Toner (6) | Comparative Compound (2) | Pulverization | 6.95 | 2.18 | 0.939 | 37.9/−6.8/C | 38.5/C |

As apparent from Table 3, the toners obtained in the present invention have high lightness and saturation and spectral reflectance characteristic having a wide gamut as compared to the comparative toners.

Further, the toners manufactured in the present invention were found to provide satisfactory contrast without causing any image fogging in output images.

Example 17

160 parts of LINEALENE DIMER A-20 (manufactured by Idemitsu Kosan Co., Ltd.) were mixed into 16 parts of a polyester resin and dispersed with an attritor (NIPPON COKE & ENGINEERING Co., LTD.) for 1 hour. A solution of 3 parts of the compound (1) and 20 parts of LINEALENE DIMER A-20 was further added in small portions to yield a colored resin dispersion. 2 parts of zirconium naphthenate (non-volatile content: 49 mass %, manufactured by DIC Corporation) were further added and then the mixture was diluted 8-fold with LINEALENE DIMER A-20 to yield a liquid developer. The volume-average particle diameter was 5.5 μm.

According to the present invention, it is possible to provide the colored resin powder which can reproduce even high lightness and saturation and has spectral reflectance characteristic having a wide gamut. It is also possible to provide the toner using the colored resin powder. The toner of the present invention not only may be applied to an image forming apparatus which adopts an electrophotographic mode but also may be used as an ink for electrostatic spray, a latex ink, a toner for a toner display to be used in electronic paper, or a toner for forming a digital fabrication circuit pattern.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-240744, filed Nov. 2, 2011, which is hereby incorporated by reference herein in its entirety.

What is claimed is:

1. A colored resin powder, comprising a water-insoluble coloring matter compound represented by the following general formula (1) and a binder resin:

General formula (1)

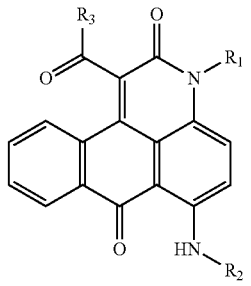

wherein in the general formula (1), $R_1$ and $R_2$ each independently represent an alkyl group, and $R_3$ represents an aryl group.

2. The colored resin powder according to claim 1, wherein $R_3$ in the general formula (1) represents one of a phenyl group and a 4-methoxyphenyl group.

3. The colored resin powder according to claim 1, wherein $R_1$ in the general formula (1) represents one of a methyl group, a butyl group, and a 2-ethylhexyl group.

4. A toner, comprising the colored resin powder according to claim 1.

* * * * *